US012766357B2

(12) United States Patent
Smith

(10) Patent No.: US 12,766,357 B2
(45) Date of Patent: Oct. 20, 2026

(54) STRENGTH TRAINING APPARATUSES AND METHODS THEREFOR

(71) Applicant: Troy R. Smith, Crown Point, IN (US)

(72) Inventor: Troy R. Smith, Crown Point, IN (US)

( * ) Notice: Subject to any disclaimer, the term of this patent is extended or adjusted under 35 U.S.C. 154(b) by 104 days.

(21) Appl. No.: 18/124,811

(22) Filed: Mar. 22, 2023

(65) Prior Publication Data

US 2023/0302322 A1 Sep. 28, 2023

Related U.S. Application Data

(60) Provisional application No. 63/322,315, filed on Mar. 22, 2022.

(51) Int. Cl.
*A63B 21/00* (2006.01)

(52) U.S. Cl.
CPC ..... *A63B 21/4029* (2015.10)

(58) Field of Classification Search
CPC ..... A63B 21/00047; A63B 21/0724; A63B 21/0726; A63B 21/078; A63B 21/0783; A63B 21/4029; A63B 21/4033; A63B 21/4035; A63B 21/4047; A63B 23/03525; A63B 23/03541; A63B 23/1281; A63B 69/0057; A63B 2208/0204; A63B 2208/0252; A63B 2225/09; A63B 2244/09

See application file for complete search history.

(56) References Cited

U.S. PATENT DOCUMENTS

| | | | |
|---|---|---|---|
| 4,240,626 | A | 12/1980 | Lambert, Jr. |
| 4,306,715 | A | 12/1981 | Sutherland |
| 4,368,884 | A | 1/1983 | Colvin |
| 4,629,183 | A | 12/1986 | Perrine |
| 4,974,839 | A | 12/1990 | Cantor |
| 5,082,260 | A | 1/1992 | Dinelli |
| 5,141,480 | A | 8/1992 | Lennox et al. |
| 5,281,193 | A | 1/1994 | Colbo, Jr. |
| 6,186,926 | B1 | 2/2001 | Ellis |
| 6,264,586 | B1 | 7/2001 | Webber |
| 6,447,430 | B1 | 9/2002 | Webb et al. |

(Continued)

FOREIGN PATENT DOCUMENTS

| | | |
|---|---|---|
| CN | 101537243 | 9/2009 |
| WO | 2020209879 | 10/2020 |

OTHER PUBLICATIONS

International Search Report for International Application No. PCT/US2019/033874, dated Jan. 10, 2020 (3 pages).

*Primary Examiner* — Gary D Urbiel Goldner

(57) ABSTRACT

Strength training apparatuses and methods therefor. The strength training apparatus includes a frame, first and second swing arms pivotally coupled to the frame and extending from the frame above a weight bench, and a user's platform armrest (UPA) releasably secured to and spanning between the swing arms. The UPA is configured to support a user's upper arms while the user is lying supine on the weight bench underneath the UPA. An angular adjusting mechanism located below a horizontal plane of the weight bench is configured to adjust an angle of the swing arms relative to the frame while the UPA is coupled to the swing arms. A platform adjusting mechanism located within the user's platform armrest is configured to adjust a position of the UPA along the swing arms while the UPA is coupled to the swing arms.

19 Claims, 29 Drawing Sheets

(56) References Cited

U.S. PATENT DOCUMENTS

| | | | | |
|---|---|---|---|---|
| 6,645,130 | B2 | 11/2003 | Webber | |
| 6,689,027 | B1 | 2/2004 | Gardikis, Jr. | |
| 6,709,370 | B1 | 3/2004 | Evans | |
| 6,896,644 | B1 | 5/2005 | Voigt | |
| 7,285,077 | B1 | 10/2007 | Marx | |
| 7,585,259 | B2 | 9/2009 | Turner | |
| 7,901,337 | B2 | 3/2011 | Webber et al. | |
| 8,740,760 | B2 | 6/2014 | York et al. | |
| 8,834,329 | B2 | 9/2014 | Kelly | |
| 9,044,643 | B2 | 6/2015 | Staten et al. | |
| 9,050,497 | B2 | 6/2015 | Reyes | |
| 10,071,276 | B2 | 9/2018 | Vorozilchak et al. | |
| 10,086,226 | B2 | 10/2018 | Nelson et al. | |
| 10,143,879 | B1 | 12/2018 | Thomas | |
| 11,013,948 | B2 | 5/2021 | Smith | |
| 2005/0192166 | A1 | 9/2005 | Shifferaw | |
| 2008/0090710 | A1 | 4/2008 | Chung | |
| 2010/0016128 | A1 | 1/2010 | Webber et al. | |
| 2010/0323857 | A1 | 12/2010 | D'Silva et al. | |
| 2012/0065038 | A1 | 3/2012 | Nayebdadash | |
| 2014/0128229 | A1 | 5/2014 | York et al. | |
| 2019/0314667 | A1 | 10/2019 | Smith | |
| 2019/0329086 | A1* | 10/2019 | Rindfleisch | A63B 21/0622 |
| 2020/0338384 | A1* | 10/2020 | Rindfleisch | A63B 21/078 |
| 2022/0219036 | A1* | 7/2022 | Anderson | A63B 23/1281 |

* cited by examiner

STRENGTH TRAINING APPARATUSES AND METHODS THEREFOR

CROSS-REFERENCE TO RELATED APPLICATIONS

This application claims the benefit of U.S. Provisional Application No. 63/322,315 filed Mar. 22, 2022, the contents of which are incorporated herein by reference.

BACKGROUND OF THE INVENTION

The present invention generally relates to exercise equipment, and more particularly to an apparatus for use in weight training upper arm muscles, and associated methods.

There are many ways to train the upper arm muscles. For example, in order to train triceps, gym lifters commonly utilize dumbbells and barbells to perform overhead, seated, or lying triceps extension exercises. Another form of training the triceps in gyms is the use of a pulley system attached to a weight stack to perform standing triceps cable extensions. As gym equipment have become more popular, numerous elaborate machines have been developed to train the triceps. Some of these machines are plate selectorized utilizing a weight stack and pin to adjust the amount of resistance, while others are plate loaded utilizing weight plates to adjust the loads. These machines include various seated versions in which a person extends (straightens) their arms against loads as well as devices that allow a person to perform a dip motion against a load.

Although gyms commonly have these types of triceps training machines, people still perform free weight lying triceps extensions (commonly called "skull crushers") with dumbbells or barbells to supplement their arm training. Many forms of lying triceps extension exercises require the user to hold and maintain their arms in a desired/optimal position that isolates the triceps while the user is lying on their back (i.e., supine). However, what is lacking are apparatuses that are commercially available to consumers and configured to assist in establishing and maintaining the proper upper arm position while performing these exercises.

In regards to training the biceps, many elaborate plate selectorized or plate loaded machines are available in gyms to train the biceps. Even with these machines available, people still perform free weight biceps curls using barbells and dumbbells just as they still opt to do free weight exercises for their triceps. For biceps, two tools are available and well known to increase the efficacy of biceps free weight exercises: the Preacher Curl bench and the self-wearing "Arm Blaster" platform, which both serve to fixate the upper arm during the curling motion. There is no known comparable device or mechanism to increase the efficacy of free weight lying triceps extension exercises. Trainers may use their hands to hold a person's arms in the proper position during lying triceps extension exercises. However, this method does not necessarily provide proper support to the upper arm, and it may hinder the ability of the trainer to provide good, finessed assistance and spotting throughout the movement. Furthermore, without a trainer present, a person is left without an option for arm support.

U.S. patent application Ser. No. 16/381,841 to Smith (U.S. Patent Publication No. US 2019/0314667 A1; referred to herein as "Smith"), assigned to the assignee of the current application, discloses strength training apparatuses that address many of the above-noted issues with previously existing equipment. The contents of Smith relating to the structure, construction, and operation of the strength training apparatuses are incorporated herein by reference. Despite the many advantages of the strength training apparatuses disclosed in Smith, it can be appreciated that there is an ongoing desire for improved apparatuses that are capable of promoting proper position while performing free weight triceps extensions while a user lies on their back (e.g., skull crushers).

BRIEF SUMMARY OF THE INVENTION

The intent of this section of the specification is to briefly indicate the nature and substance of the invention, as opposed to an exhaustive statement of all subject matter and aspects of the invention. Therefore, while this section identifies subject matter recited in the claims, additional subject matter and aspects relating to the invention are set forth in other sections of the specification, particularly the detailed description, as well as any drawings.

The present invention provides, but is not limited to, strength training equipment and methods suitable for use in weight training upper arm muscles.

According to one aspect of the invention, a strength training apparatus is provided for use with free weights. The strength training apparatus includes a frame configured to rest on a surface, first and second swing arms each pivotally coupled to the frame at respective pivot points and extending from the frame above a weight bench coupled to the frame, and a user's platform armrest configured to be releasably secured to the first and second swing arms and span therebetween. The user's platform armrest has a first side configured to support a user's upper arms while the user is lying supine on the weight bench located below and underneath the user's platform armrest. An angular adjusting mechanism is located below a horizontal plane of the weight bench and configured to adjust an angle of the first and second swing arms relative to the frame while the user's platform armrest is coupled to the swing arms. A platform adjusting mechanism is located within the user's platform armrest and configured to adjust a position of the user's platform armrest along the first and second swing arms while the user's platform armrest is coupled to the swing arms.

According to another aspect of the invention, a method is provided for performing a triceps extension exercise using a strength training apparatus. The method includes adjusting an angle of first and second swing arms relative to a frame of the strength training apparatus while a user's platform armrest is coupled to the swing arms by interacting with components of the frame located below a weight bench coupled to the frame, lying supine on the weight bench below and underneath the user's platform armrest of the strength training apparatus, adjusting a position of the user's platform armrest along the first and second swing arms downward toward the weight bench while the user's platform armrest is coupled to the first and second swing arms by single-handedly interacting with one or more components located within the user's platform armrest while lying supine on the weight bench below and underneath the user's platform armrest, holding a free weight with one or both hands, locating and maintaining one or both upper arms against a side of the user's platform armrest, and performing an exercise by repeatedly extending and bending one or both arms at the elbows while holding the free weight with one or both hands of the one or both arms and while the one or both upper arms are against a side of the user's platform armrest. In some arrangements, the angle adjustment can be accomplished by using fingers on each hand with components located atop each swing arm while standing behind the bench, for example.

According to another aspect of the invention, a method is provided for performing a biceps curling exercise using a strength training apparatus. The method includes adjusting an angle of first and second swing arms relative to a frame of the strength training apparatus while a user's platform armrest is coupled to the swing arms by interacting with components of the frame located below a weight bench coupled to the frame, adjusting a position of the user's platform armrest along the first and second swing arms upward away from or downward toward the weight bench while the user's platform armrest is coupled to the first and second swing arms by single-handedly interacting with one or more components located within the user's platform armrest, holding a free weight with a hand while the leaning over the user's platform armrest, locating and maintaining one or both upper arms against a side of the user's platform armrest such that the user's platform armrest is between the one or both upper arms and the weight bench, and performing the biceps curling exercise by repeatedly extending and bending one or both arms at the elbows while holding the free weight and while the one or both arms are against the side of the user's platform armrest. In some arrangements, the angle adjustment can be accomplished by using fingers on each hand with components located atop each swing arm while standing behind the bench, for example.

In some arrangements, the apparatus and methods described herein provide the capability of properly supporting a user's upper arms while the user performs various extensions and curling flexions during weight training with free weights, thereby promoting muscle building, increased exercise efficacy, increased neurological adaptation, and safety.

These and other aspects, arrangements, features, and/or technical effects will become apparent upon detailed inspection of the figures and the following description.

DETAILED DESCRIPTION OF THE INVENTION

Figure 1:
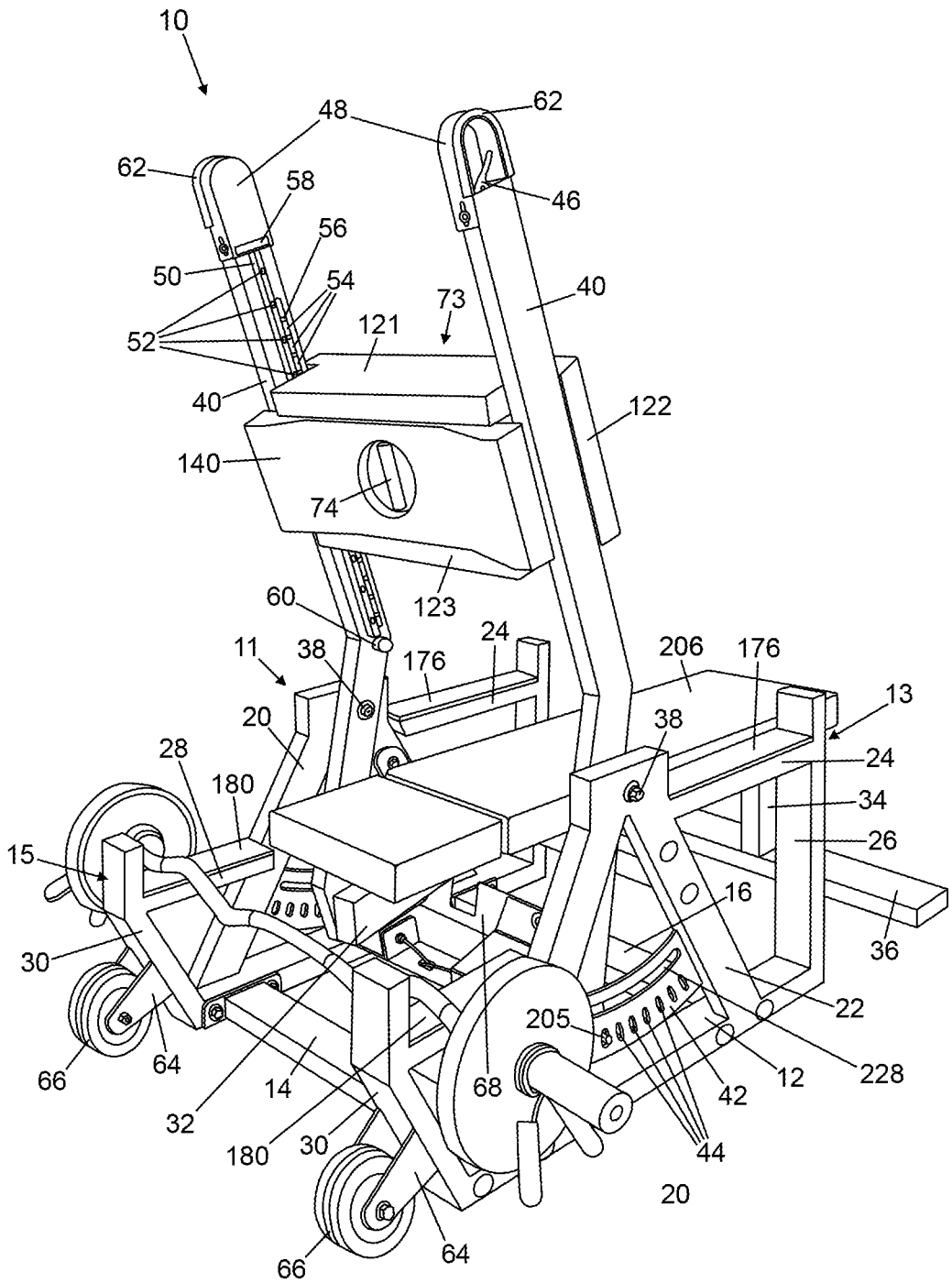
FIG. 1 is a right rear isometric view of a strength training apparatus according to a first non-limiting embodiment including a user's platform armrest for supporting a user's upper arms while performing certain exercises.
Figure 2:
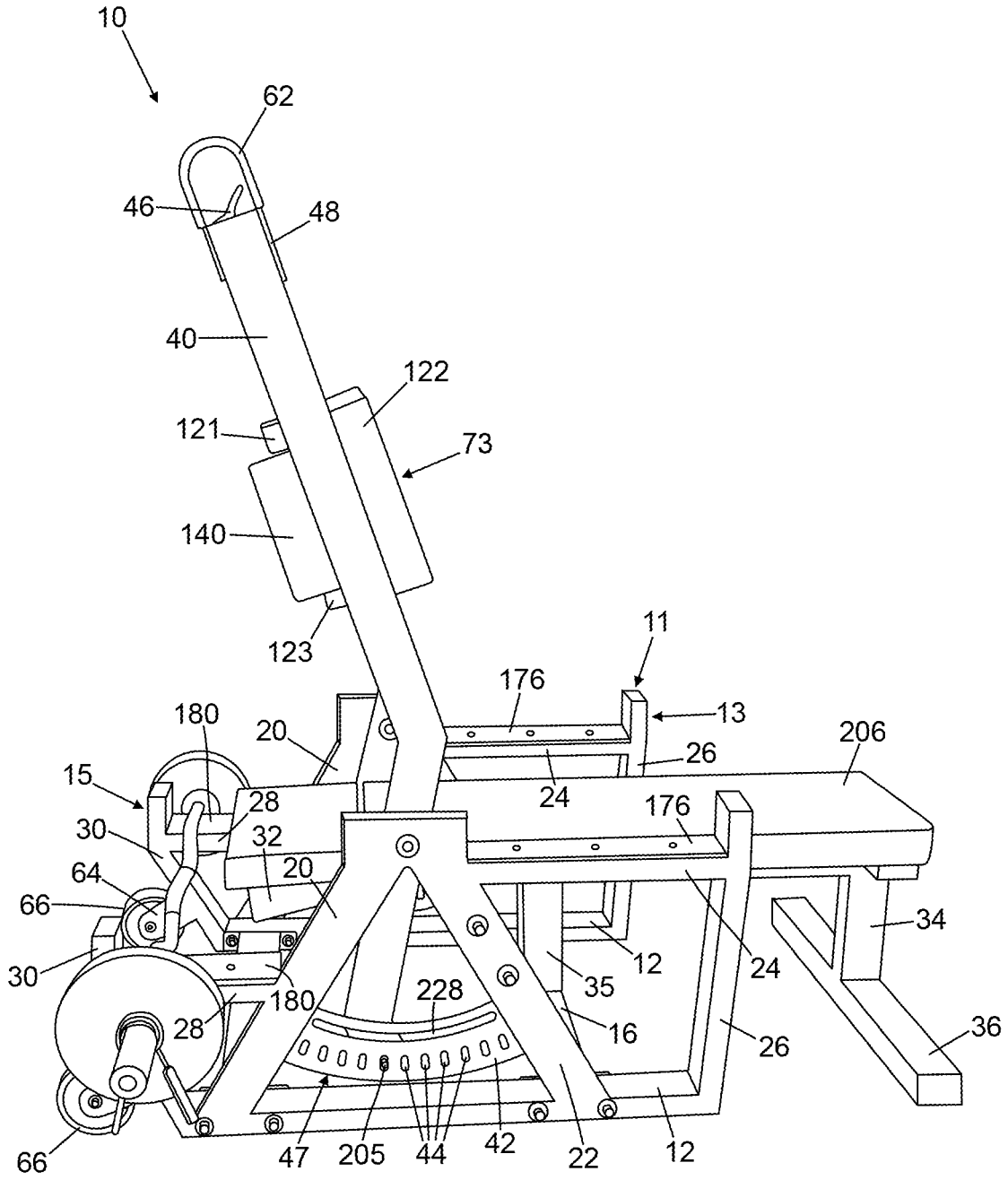
FIG. 2 is a right side view of the strength training apparatus of FIG. 1.
Figure 3:
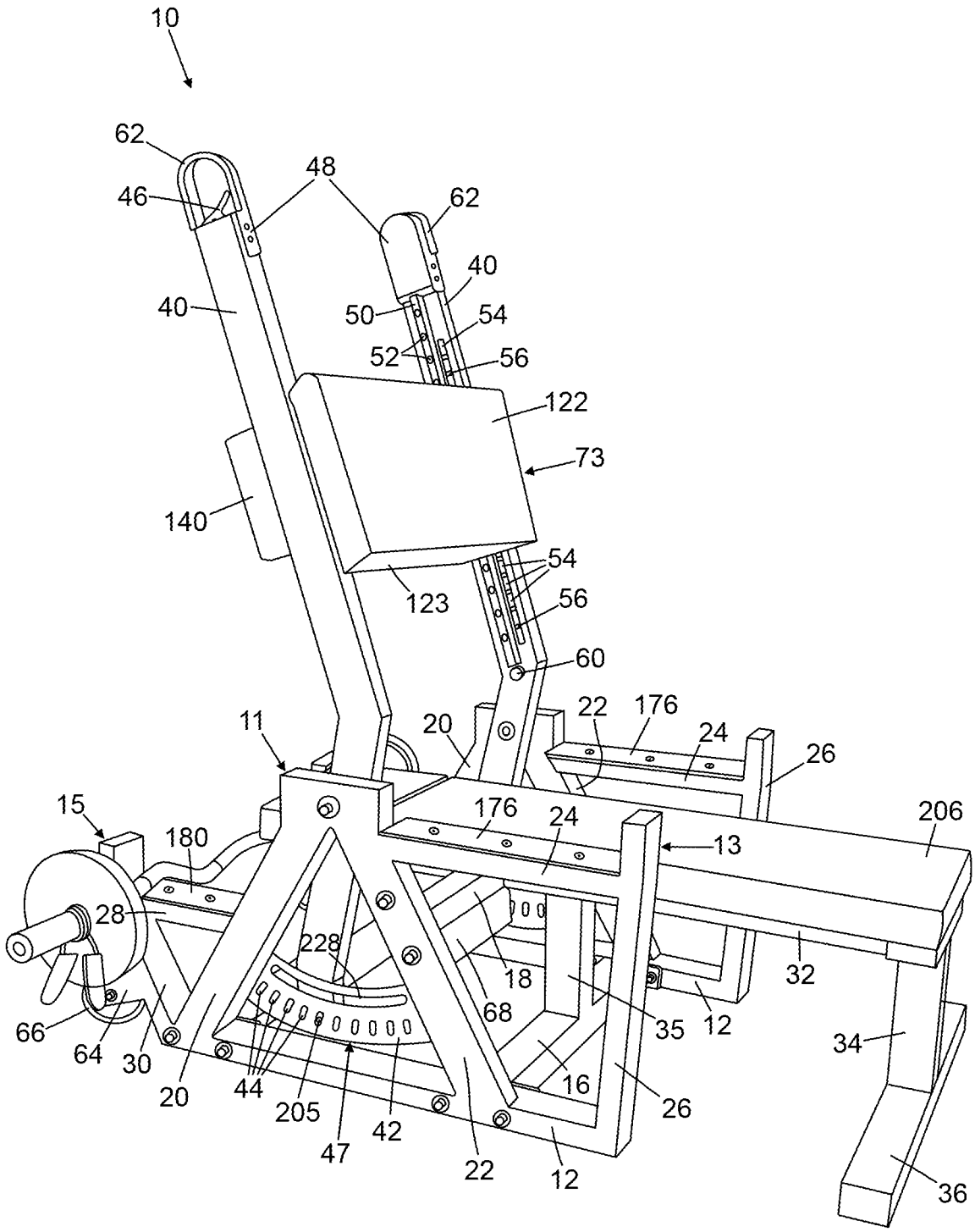
FIG. 3 is a right front perspective view of the strength training apparatus of FIG. 1.
Figure 4:
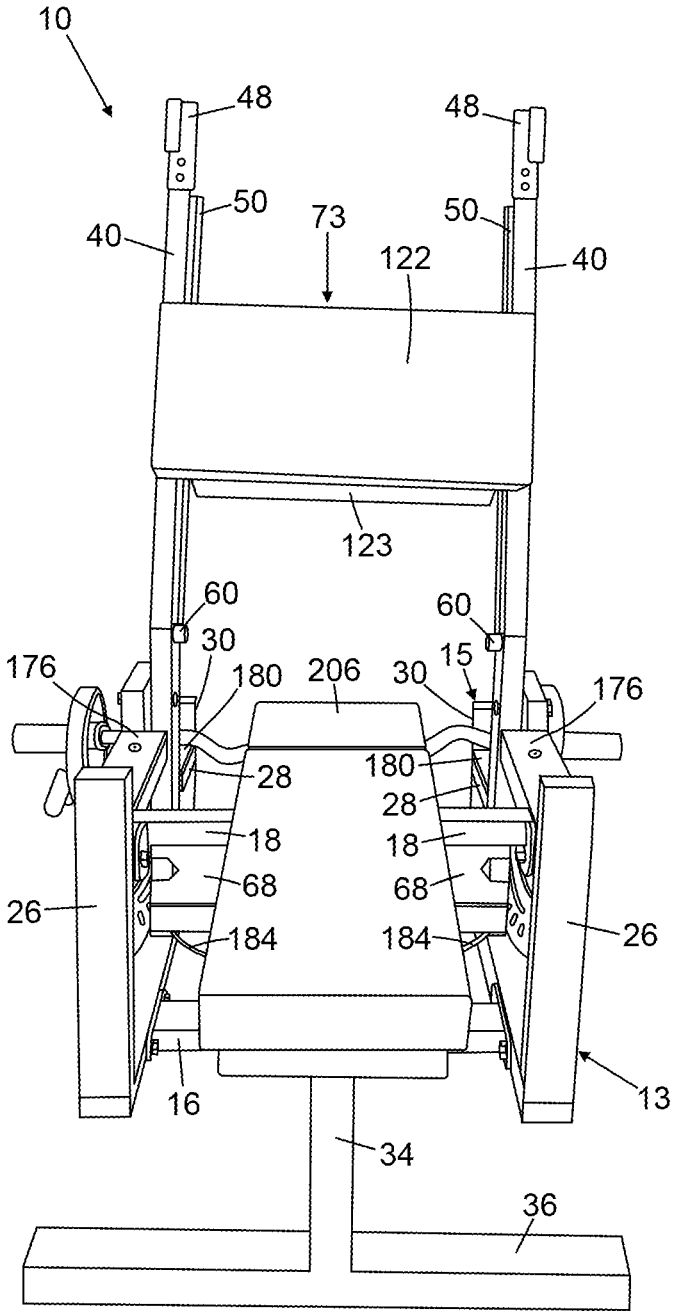
FIG. 4 is a front elevation view of the strength training apparatus of FIG. 1.
Figure 5:
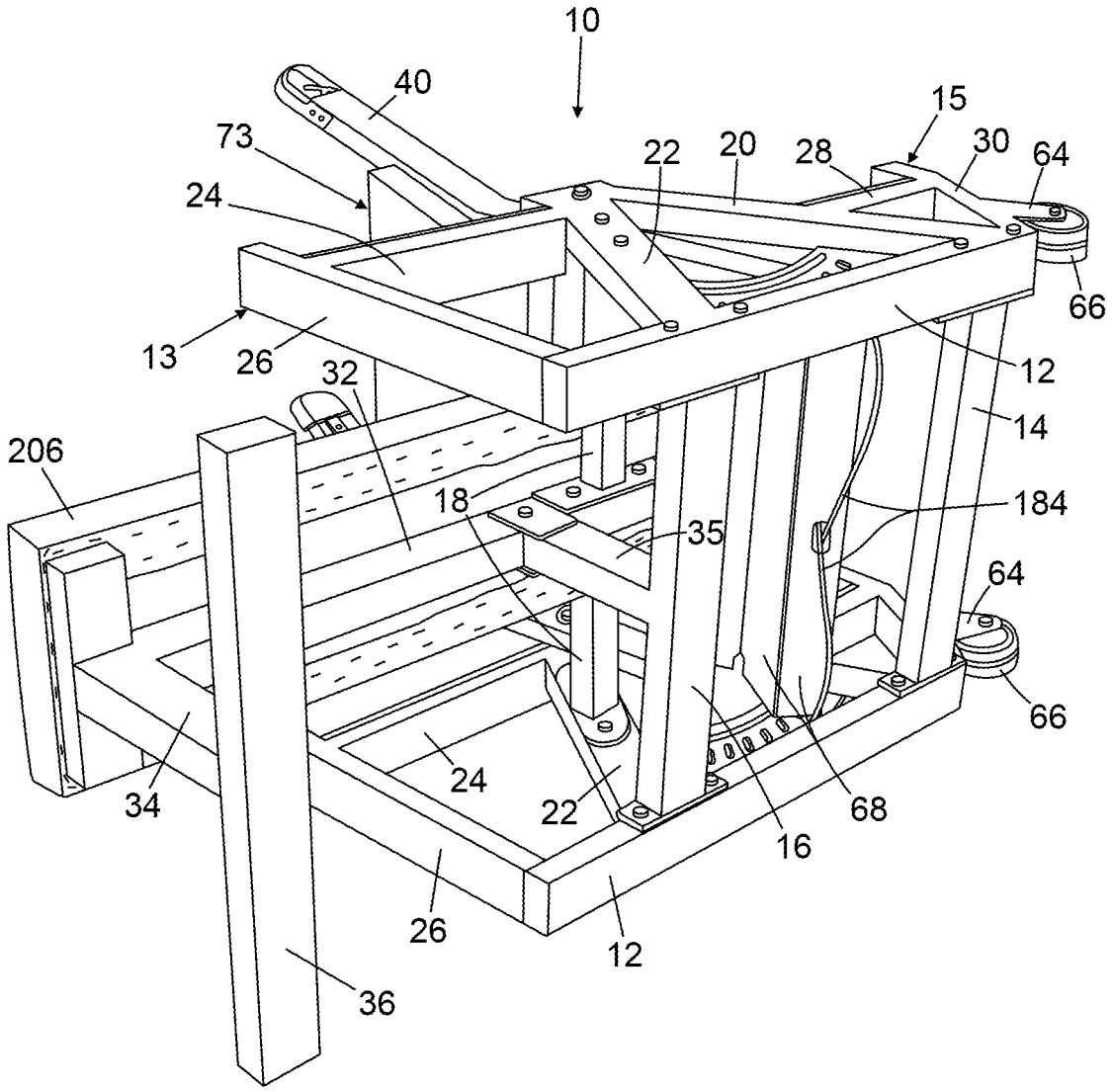
FIG. 5 is a bottom is bottom front left perspective view of the strength training apparatus of FIG. 1.
Figure 6:
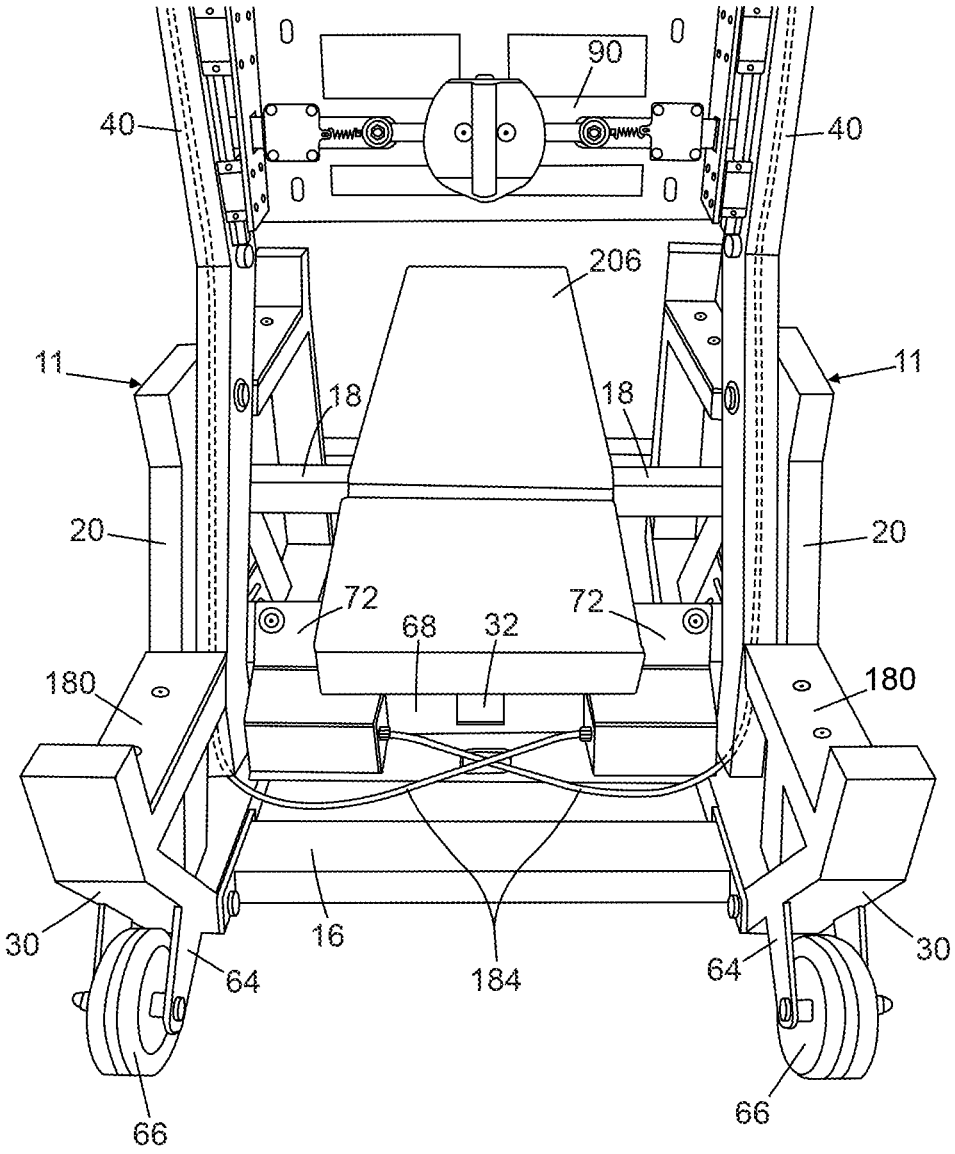
FIG. 6 is rear end view of the strength training apparatus of FIG. 1 that illustrates a pair of cables routed through components of the strength training apparatus.

The intended purpose of the following detailed description of the invention and the phraseology and terminology employed therein is to describe what is shown in the drawings, which include the depiction of and/or relate to one or more nonlimiting embodiments of the invention, and to describe certain but not all aspects of the embodiment(s) to which the drawings relate. The following detailed description also identifies certain but not all alternatives of the embodiment(s). As nonlimiting examples, the invention encompasses additional or alternative embodiments in which one or more features or aspects shown and/or described as part of a particular embodiment could be eliminated, and also encompasses additional or alternative embodiments that combine two or more features or aspects shown and/or described as part of different embodiments. Therefore, the appended claims, and not the detailed description, are intended to particularly point out subject matter regarded to be aspects of the invention, including certain but not necessarily all of the aspects and alternatives described in the detailed description.

To facilitate the description provided below of the training benches represented in the drawings, relative terms, including but not limited to, "vertical," "horizontal," "lateral," "medial," "front," "rear," "side," "forward," "rearward," "upper," "lower," "above," "below," "right," "left," etc., may be used in reference to an orientation of the benches during their use. All such relative terms are intended to indicate the construction, installation and use of the benches and therefore help to define the scope of the invention.

Disclosed herein are nonlimiting strength training apparatuses configured to support one or both of a user's upper arms during weight training exercises, particularly for training biceps and triceps with free weights. In particular, the apparatuses (referred to hereinafter as training benches) provide for the support and positioning of one's arm(s) during upper arm strength training in order to promote proper technique. The training bench is preferably capable of supporting a user's arm(s) while the user is lying in a supine position and performing supine triceps extensions with barbells, dumbbells, or the like. Preferably, the training bench is configured to position the upper arm(s), for example, approximately zero to fifty degrees backwards (e.g., toward the rear of the training bench) from vertical while the user is lying supine. It is also within the scope of the invention that the training bench may be configured to support a user's arm(s) while the user performs biceps curls with barbells, dumbbells, or the like. In such embodiments, the training bench is configured to position the user's arm(s), for example, approximately zero to fifty degrees backwards (e.g., toward the rear of the training bench) while the user stands behind the training bench and positions his or her arm(s) over/atop the second side of the user's platform armrest.

In order to assist in both triceps and biceps weight training as described above, the training benches preferably include a suspended, double-sided platform (referred to herein as a user's platform armrest, or UPA) located above and over a weight bench to support a user's upper arm(s) while lying on his/her back on the weight bench. The platform is preferably adjustable in both an upward/downward fashion (e.g., relative to the weight bench) as well as an angular fashion with respect to vertical. The UPA is also preferably capable of being configured to support a user's upper arm(s) while standing behind the training bench with the user's arm(s) over the top of the UPA.

FIGS. 1 through 21 schematically represent various aspects of a training bench 10 in accordance with a first nonlimiting embodiment. The nonlimiting embodiment of the training bench 10 includes a frame 11 configured to rest on a support surface (e.g., floor, ground, etc.), an integral weight bench 206 having padding material thereon for supporting a user, and a UPA (user's platform armrest) 73 whose suspended platform has four surfaces or sides, a first side against which a user's upper arm(s) can be placed during lying triceps extensions (rear pad 140) and a second side (front pad 122) against which the user's upper arm(s) can be placed during standing or kneeling biceps curls, and third and fourth sides (upper and lower pads 121 and 123) which provide cushioning when manually changing a position of the UPA 73 and may further be used for supporting portions of the user's upper arm(s) or chest while performing certain exercises.

For convenience, the frame 11 will be referred to as having a front end 13 and a rear end 15. The frame 11 includes a pair of spaced apart, vertical sides coupled to one another such that they stand parallel to one another. Each of the sides of the frame 11 include a side base member 12 along a bottom thereof. A front end member 26 and a rear end member 30 are coupled to opposite ends of the side base member 12 and generally define longitudinal ends of the sides of the frame 11. A rear main support member 20 and a front main support member 22 are located between the front and rear end members 26 and 30, connect to the side base member 12 at lowermost ends thereof, and connect to one another at uppermost ends thereof to define a triangular structure (e.g., an A-frame). A front brace member 24 connects the front end member 26 to the front main support member 22, and a rear brace member 28 connects the rear end member 30 to the rear main support member 20.

The sides of the frame 11 are coupled to one another with at least a rear cross brace member 14 and a mid-cross brace member 16 generally near a rear end and a middle portion thereof, respectively. Additional cross brace members may be included in connecting the sides of the frame 11 for further support. In the represented embodiment, the training bench 10 includes a pair of additional cross brace members 18 connecting the front main support members 22 of the sides of the frame 11 to a weight bench support member 32 aligned along a central longitudinal axis of a lower surface of the weight bench 206. The weight bench 206 in a standard operating/use position is generally horizontal defining a horizontal plane, as seen in FIG. 1. A mid support member 35 connects the weight bench support member 32 to the mid cross brace member 16, and a front support member 34 connects the weight bench support member 32 to a front base member 36. The rear end 15 of the training bench 10 may include wheels 66 to promote ease of portability of the training bench 10. In this embodiment, each of the wheels 66 are rotatably coupled to a respective one of the rear end members 30 with a pair of wheel support brackets 64.

Front and rear barbell racks are provided on the sides of the frame 11 that include front and rear rack platforms 176 and 180, respectively, that are configured to accept and support barbells. The rack platforms 176 and 180 may include compressible stoppers (e.g., rubber) or padding thereon to protect the barbells and mitigate noise. The rack platforms 176 and 180 could be, for example, approximately twenty five inches apart to accept standard barbells, for example, EZ curl barbells. For the front barbell racks, the front rack platforms 176 could be, for example, seventeen inches above the ground in order for the bars to rest on them without touching the weight bench 206. For the rear barbell racks, the rear rack platforms 180 could be, for example, approximately eleven inches from ground in order for the resting position of the barbell to be approximately five inches below the height of the weight bench 206 (e.g., about sixteen inches).

A pair of spaced apart swing arms 40 are pivotally coupled at pivot joints 38 to upper, medial sides of the A-frames defined by the rear and front main support members 20 and 22 of respective ones of the sides of the frame 11. The pivot joints 38 may include various components configured for promoting pivoting of the swing arms 40 including, for example, bolts, pressed in flange bearings, friction mitigation spacing washers, axle washers, and bolt nuts.

A swing arm angle adjuster system 47 is configured for adjusting the angle of the first and second swing arms. The swing arm angle adjuster system 47 includes upwardly curved selector plates 42 that are disposed below the horizontal plane of the weight bench 206 and that span between and connect to the rear and front main support members 20 and 22. Lower ends of the swing arms 40 are configured to be releasably coupled with the selector plates 42. The selector plates 42 each include multiple holes 44 that are equidistant from their respective pivot joints 38. The lower ends of the swing arms 40 include spring loaded pop pins (lock pins) 205 that are biased in directions toward their respective selector plates 42 (i.e., lateral directions). The pop pins 205 can preferably be selectively inserted and mated with one of the holes 44 to allow for the swing arms 40 to be releasably coupled to the selector plates 42. The pop pins 205 are represented as capable of being manually removed from one of the holes 44 by articulating swing arm levers 46 located in recesses in upper lateral sides of top end caps 48 that enclose the upper ends of the swing arms 40. Optionally, the top end caps 48 may include covers 62.

By releasably securing the swing arms 40 to the holes 44, an angle of the swing arms 40 and thereby the UPA 73 are represented as capable of being adjusted relative to vertical (e.g., perpendicular to the weight bench 206) to allow for adjusting the relative loads experienced by users at particular ranges of motion during use as well as adjusting the fixation angle based on user preference, for example, by using fingers on each hand with components located atop each swing arm 40 while standing behind the weight bench 206. For example, the holes 44 may be spaced apart from one another to allow upper portions of the swing arms 40 to be positioned at various predetermined angles, for example, ranging from approximately zero to fifty degrees from vertical toward the rear end 15 of the training bench 10. It is believed that adjusting the UPA 73 to angles increasingly further from vertical (e.g., up to about fifty degrees) not only promotes constant tension at an end range of extension movements but also may promote improved targeting of the long head of the triceps. In addition, varying the angle of the UPA 73 for biceps curling (e.g., up to about fifty degrees) changes the amount of loading experienced on the biceps at the end ranges of motion of curling motions.

Actuator cables 184 functionally couple the swing arm levers 46 to the pop pins 205 such that articulating the swing arm levers 46 pulls the cables 184 and thereby pulls the pop pins 205 away their corresponding selector plates 42 (i.e., medial directions) to an extent that the pop pins 205 exit the holes 44. As such, the swing arms 40 are free to pivot about the pivot joints 38 while the swing arm levers 46 are held in an articulated position. During this action, the pop pins 205 are maintained in a retracted position and when the swing arm levers 46 are released and the tension on the cables 184 is relieved, the pop pins 205 are biased toward the selector plates 42 (i.e., lateral directions) and preferably into one of the holes 44 to releasably fix the swing arms 40 in position. The selector plates 42 may optionally include guide slots 228 with a curved central axis that is equidistant from each of the holes 44. The swing arms 40 may include a fixed peg, spring-loaded pop pins, or other structures that are configured to be received within the guide slots 228 such that, in combination, the guide slots 228 and the fixed peg guide the swing arms 40 as they pivot between the holes 44.

Figure 7:
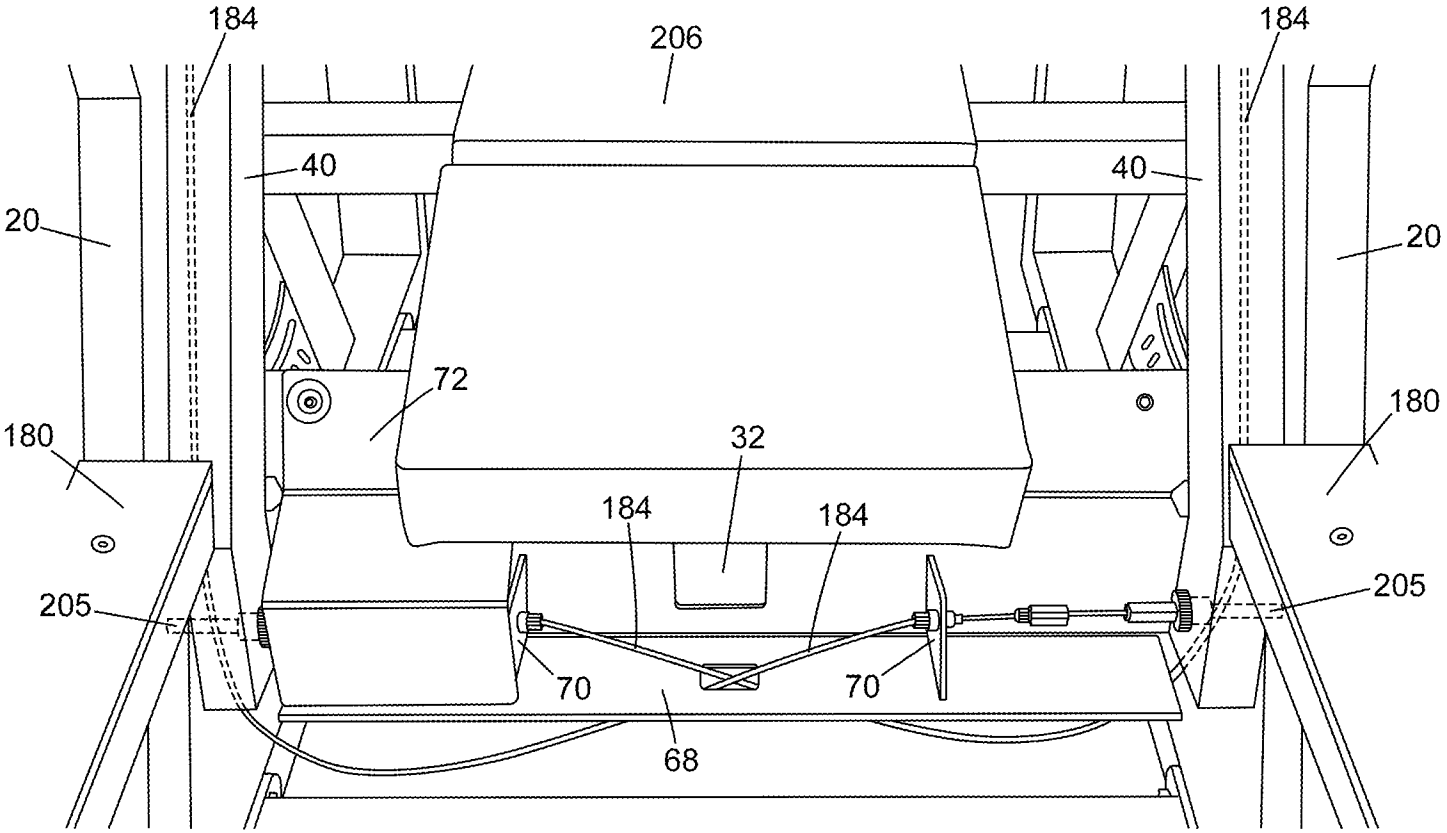
FIG. 7 is an enlarged rear view of an area of the strength training apparatus of FIG. 1 showing pop pin (lock pin) assemblies with one of the cover plates and certain components of the lock pin assembly associated therewith on a right side of the figure omitted for clarity.

The cables 184 are represented as capable of being routed through interior cavities of the swing arms 40 from the swing arm levers 46, below the level of the weight bench 206, and routed to their corresponding pop pins 205. In FIG. 7, the cables 184 are represented as routed between the sides of the frame 11 such that a first of the cables 184 connected to a first of the swing arm levers 46 on a first of the swing arms 40 is coupled to a second pop pin 205 on a second of the swing arms 40. Likewise, a second of the cables 184 connected to a second of the swing arm levers 46 on a second of the swing arms 40 is coupled to a first pop pin 205 on the first swing arm 40. The swing arms 40 may include internal cable guides (not shown) to support and guide the cables 184 within the swing arms 40 and thereby reduce the likelihood of the cables 184 interacting with other components therein, such as screws or other fasteners. The upper end caps 48 may be releasably coupled to the upper ends of the swing arms 40, for example, with fasteners such as threaded bolts such that the upper end caps 48 can be removed for maintenance of the actuator cables 184 and other internal components of the swing arms 40.

Figure 8:
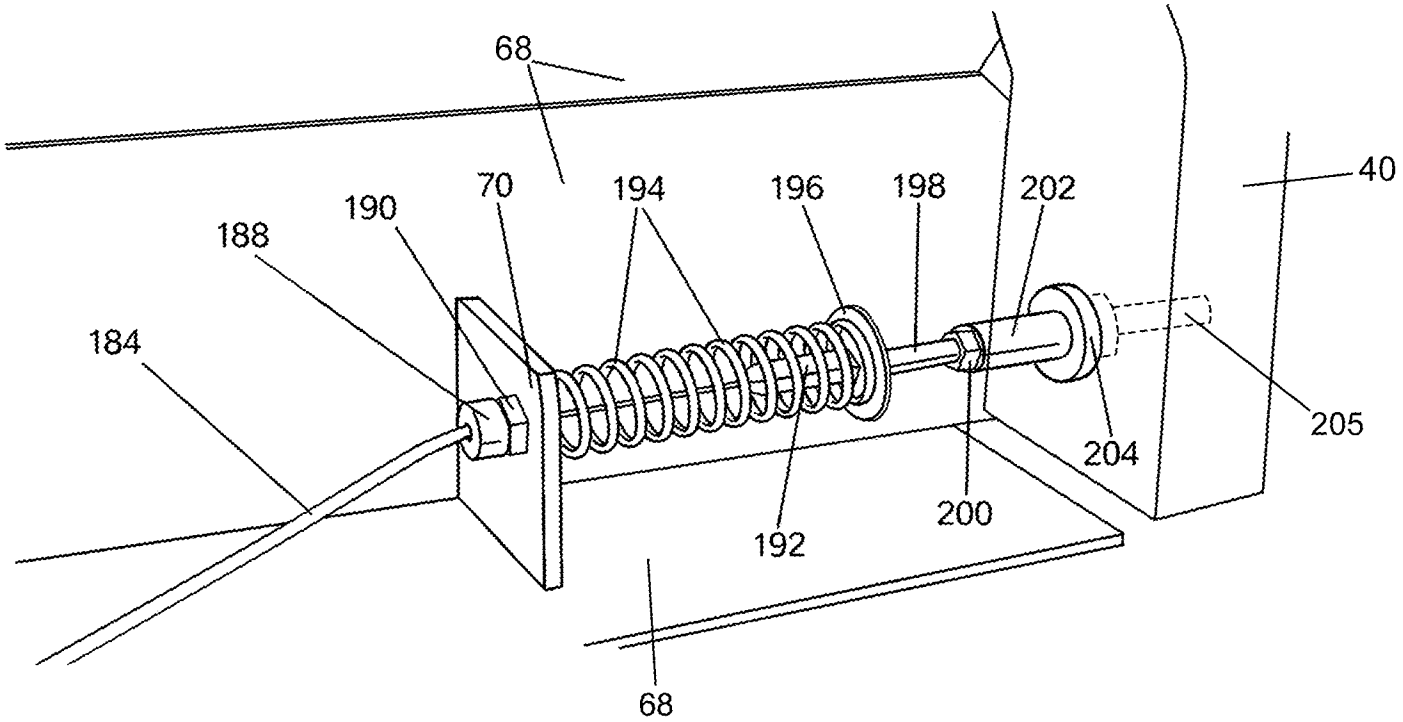
FIG. 8 is an enlarged perspective view one of the lock pin assemblies on the right side of FIG. 7 with the corresponding cover plate omitted for clarity.
Figure 9:
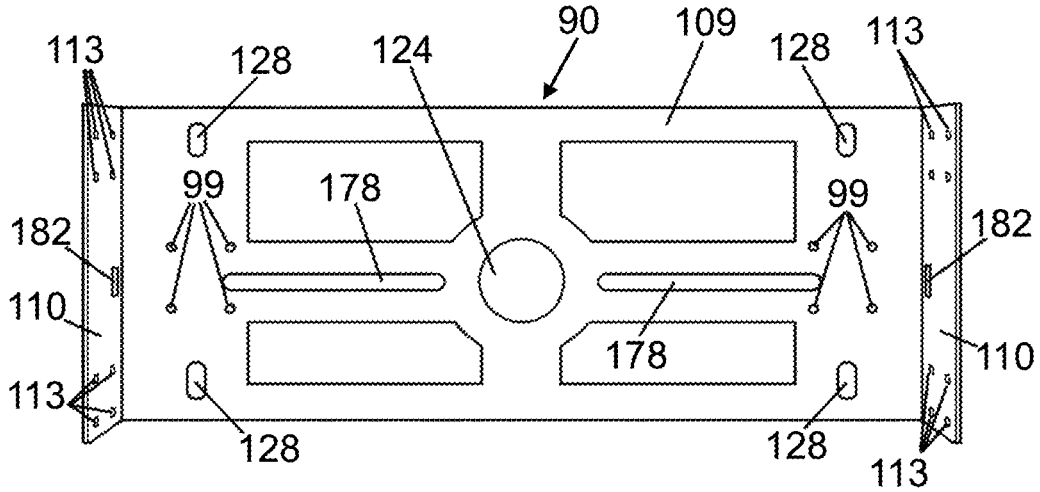
FIG. 9 is an isolated front view of a frame component of a user's platform armrest of the strength training apparatus of FIG. 1.
Figure 10:
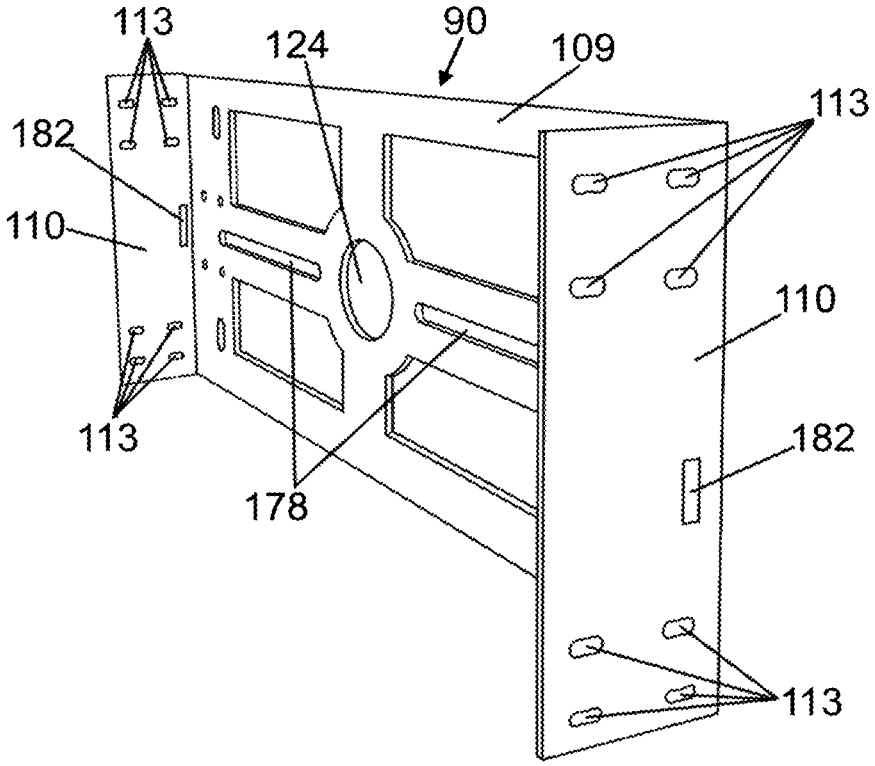
FIG. 10 is an isolated perspective view of the frame component of FIG. 9.

To protect and/or support the cables 184 over the span between the sides of the frame 11, the training bench 10 includes a kickplate 68 that connects between the lower ends of the swing arms 40 and defines a front wall and a lower wall therebetween (FIG. 7). A pair of cable supports 70 are fixed to adjacent surfaces of the front wall and the lower wall of the kickplate 68 (FIGS. 7 and 8). Cover plates 72 are fixed to the kickplate 68 and include surfaces that define a rear wall and an upper wall that are spaced apart and opposite the front and lower walls of the kickplate 68, respectively. In combination, the front and lower walls of the kickplate 68, the rear and upper walls of the cover plates 72, lateral sides of the cable supports 70, and medial sides of the swing arms 40 define a housing with a cavity therebetween. Each of the cables 184 that are coupled to the swing arm levers 46 may exit medial sides of the swing arms 40 near the lower ends of the swing arms 40, continue through and past the corresponding cable supports 70, and functionally coupled therethrough with a cable coupling nut 192 located within the cavity of the housing.

The cables 184 are coupled to their respective pop pin 205 with pop pin assemblies. The pop pin assemblies include an actuator extension rod 198 secured between the cable coupling nut 192 and an actuator extension rod to spring plunger coupling nut 202. Actuator extension rod nuts 200 promote a proper position of the actuator extension rod 198 as well as hold a compression spring stop washer 196 seated on a medial end of the actuator extension rod 198. The extension rod to spring plunger coupling nut 202 secures to a spring plunger 204 that is affixed adjacent a bottom end of a corresponding one of the swing arms 40. The pop pin 205 (e.g., end pin) of the spring plunger 204 extends outward laterally to enter the selector plate holes 44, effectively securing the swing arms 40 and the UPA 73 in a predetermined angle relative to vertical.

When an individual actuates both of the swing arm levers 46, the pop pins 205 are retracted toward the swing arms 40, releasing the swing arms 40 from the selector plates 42 and allowing the swing arms 40 to rotate with respect to vertical about the pivot joints 38. Compression Springs 194 are seated around each of the actuator cables 184 within the housing between the cable supports 70 and the compression spring stop washers 196. The compression springs 194 act as biasing elements to cause the swing arm levers 46 and the pop pins 205 to return to their resting position upon release of the swing arm levers 46.

The aforementioned UPA 73 is coupled to and spans between the swing arms 40. The UPA 73 includes an assembly that has what will be referred to collectively herein as external components of the UPA 73 that include a front pad component 117, a rear pad base component 129, and a rear pad component 139 all coupled to a UPA frame 90. The assembly further includes various internal components coupled to the UPA frame 90 and at least partially enclosed within the external components.

FIGS. 9 through 13 show the UPA frame 90 and internal components of the UPA 73 with the exterior components removed for clarity. The UPA frame 90 includes a main member 109 and a pair of oppositely disposed end members 110 fixed to ends of the main member 109 and oriented perpendicular thereto. Linear bearing sliders 112 are coupled to the end members 110 of the UPA frame 90 with bolts 114 and configured to couple with and slide along rails 50 located along medial sides of the swing arms 40 between upper and lower stoppers 58 and 60. The UPA frame 90 is configured to slide along the rails 50 and be releasably fixed in predetermined locations thereon by interacting with a locking plate 56 located within the swing arms 40, aligned parallel to the rails 50, and having slots 54 in the locking plates 56 exposed along medial sides of the swings arms 40.

Figure 11:
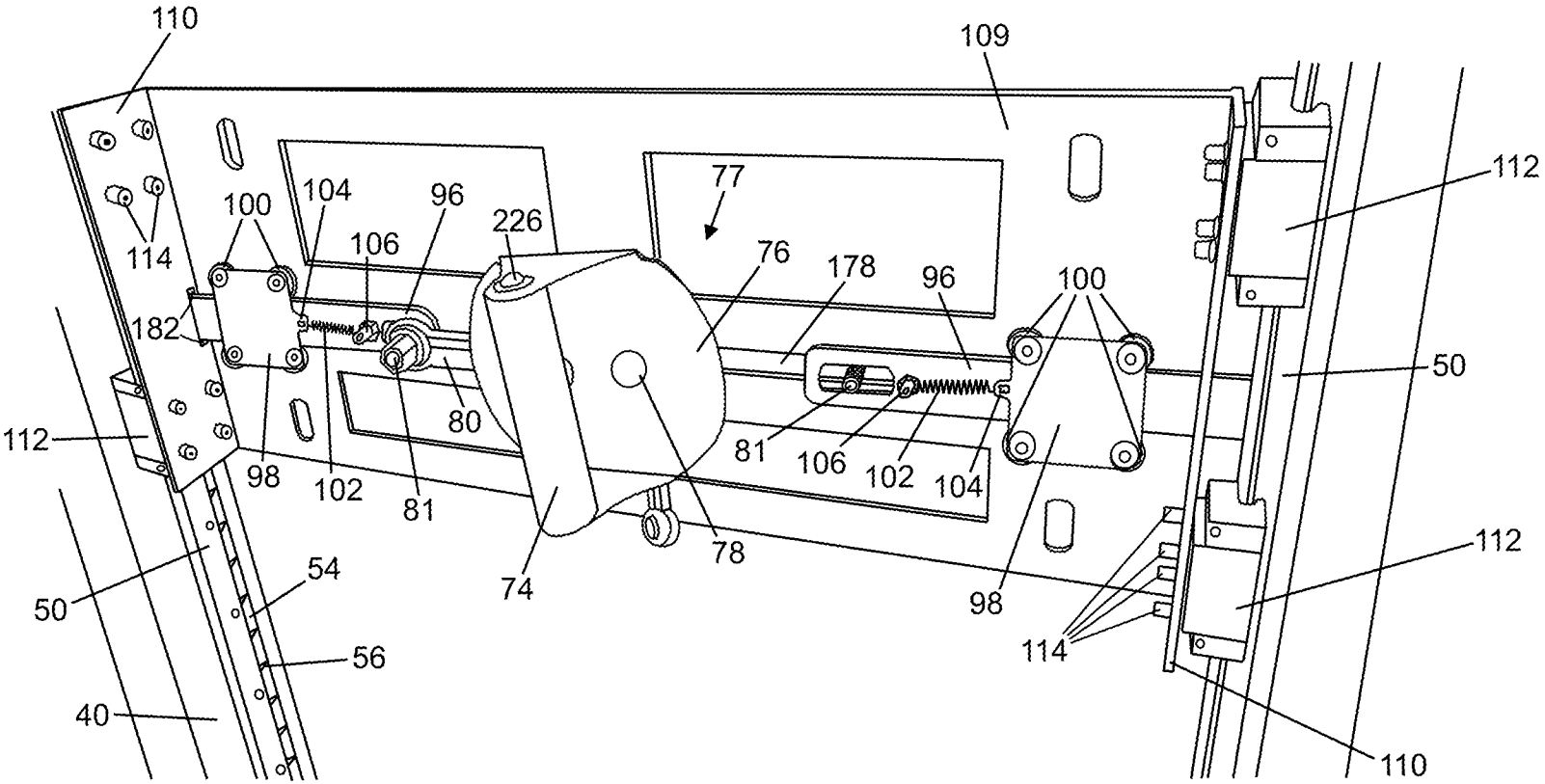
FIG. 11 is an enlarged perspective view of the user's platform armrest frame of FIG. 9 as installed coupled between swing arms of the strength training apparatus of FIG. 1 with one of the rod ends decoupled for clarity on a right side of the figure.
Figure 12:
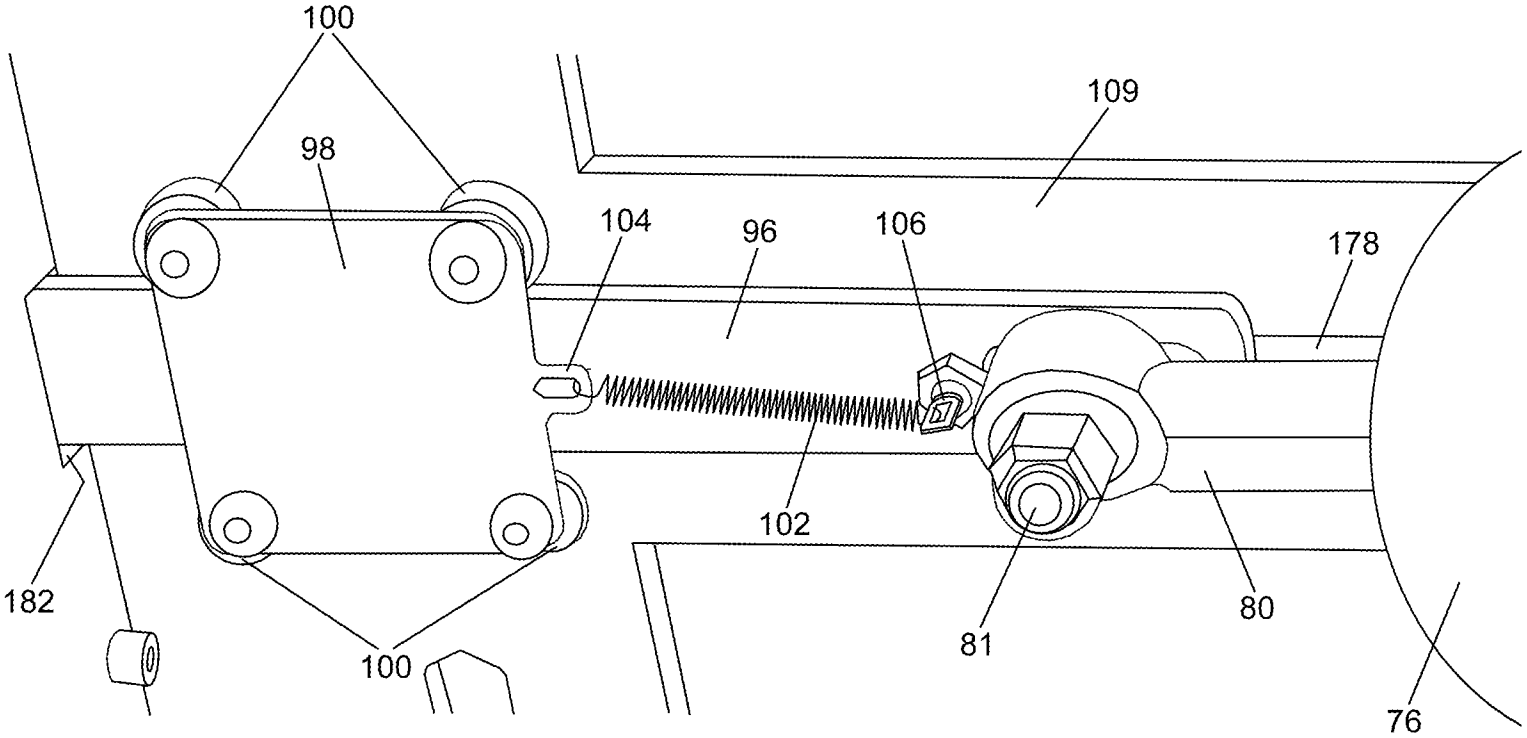
FIG. 12 is an enlarged perspective view of a locking finger assembly of a user's platform armrest frame as installed in FIG. 11.

A platform adjustment system 77 is used to adjust a position of the UPA 73 along the length of the swing arms 40 while the UPA 73 is coupled to the swing arms 40. The platform adjustment system 77 is located primarily within the UPA 73. As represented in FIG. 11, locking fingers 96 are coupled to and oriented along a longitudinal axis of the main member 109 of the UPA frame 90 and slidably fixed thereto. Locking finger frame bolts 81 slidably secure medial ends of each locking finger 96 to the UPA frame 90 through locking finger frame slots 178 of the main member 109. Guide plates 98 are fixed to the main member 109 of the UPA frame 90 and include bearing wheels 100 in contact with edges of the locking fingers 96. The guide plates 98, the locking finger frame bolts 81, and the locking finger frame slots 178 are configured to guide the locking fingers 96 as they slide along the longitudinal axis of the UPA frame 90. A spring 102 is connected to each of the locking fingers 96 with a fastener 106 (e.g., jam nut) at a first end thereof and to a corresponding retaining member 104 of each of the guide plates 98 at a second end thereof. The springs 102 bias the locking fingers 96 in lateral directions along the longitudinal axis of the UPA frame 90. The locking fingers 96 are configured to have lateral ends that extend beyond the ends of the UPA frame 90 through the end members 110 and are configured to be received within the slots 54 of the locking plates 56. While retained within the slots 54 of the locking plates 56, the locking fingers 96 act as barriers that releasably maintain the UPA 73 in fixed locations along the swing arms 40.

In order to adjust a position of the UPA 73 along the swing arms 40 using the platform adjustment system 77, the locking fingers 96 must be temporarily retracted from the slots 54 of the locking plates 56. Therefore, the platform adjustment system 77 includes a rotary release assembly 57 that is configured to pull the locking fingers 96 inward (medial directions) to simultaneously remove the locking fingers 96 from the slots 54. The rotary release assembly includes a handle 74 that is rotatably coupled to the main member 109 of the UPA frame 90 and capable of being rotated clockwise and/or counterclockwise to release the UPA 73 from the locking plates 56. As seen in FIG. 11, the rotary release assembly 57 includes a rotary disc 76 connected to the handle 74, and rod ends 80 having lateral ends connected to the locking fingers 96 via the locking finger frame bolts 81 and medial ends rotatably connected to anchor points about assembly bolts 78 of the rotary disc 76. Rotation of the handle 74, and thereby the rotary disc 76, rotates the anchor points about a center axis of the rotary disc 76 pulling the locking fingers 96 inward via the rod ends 80. The handle 74 may be held in this rotated position while moving the UPA 73 such that the lateral ends of the locking fingers 96 are maintained clear of the locking plate 56. Releasing the handle 74 causes the rotary disc 76 to rotate and return to its original position due to the biasing force of the springs 102, and thereby allows the lateral ends of the locking fingers 96 to be inserted into the holes 56. In addition to the biasing force of the springs 102, secondary return springs (not shown) may be provided that couple the UPA frame 90 and the rotary disc 76 which extend upon rotation of the rotary disc 76 and serve to bias the rotary disc 76 to an original resting position. Therefore, the rotary release assembly allows for the UPA 73 to be selectively locked in and released from varying positions along the rails 50 with a single hand by interacting with the handle 74.

Figure 13:
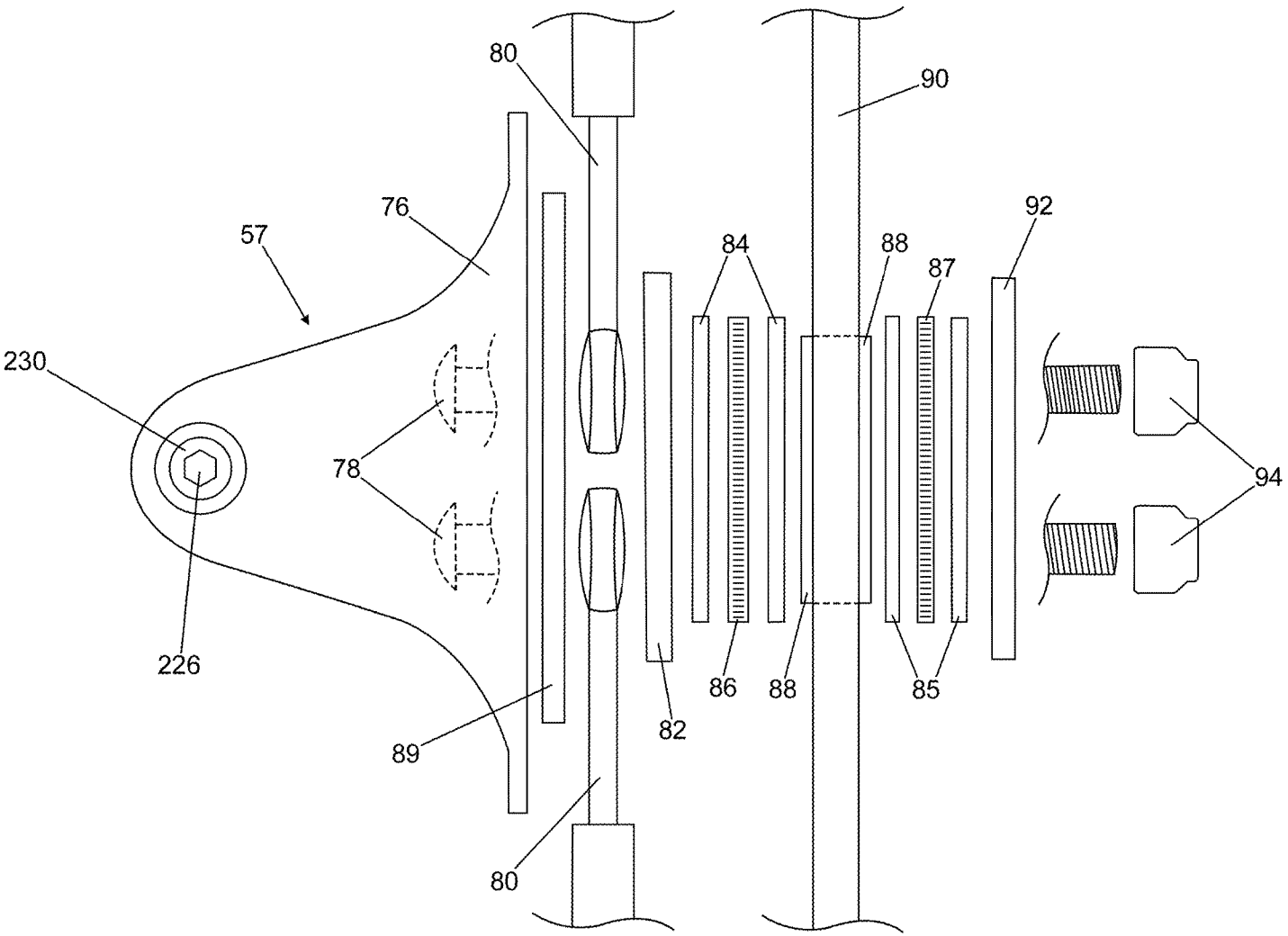
FIG. 13 is a partially exploded view of a rotary release assembly of the strength training apparatus of FIG. 1.

The rotary release assembly 57 may have various components and constructions suitable for rotatably coupling the handle 74 and the rotary disc 76 to the UPA frame 90. FIG. 13 is an exploded view of a nonlimiting embodiment of the rotary release assembly. In this embodiment, the handle 74 is coupled to the rotary disc 76 with a handle bolt 226 and a handle nut 230. Additional components of the assembly are secured to the UPA frame 90 with the assembly bolts 78 and assembly nuts 94 which pass through a rotary release assembly hole 124 of the UPA frame 90.

In general, the rotary release assembly rotates within the rotary release holes 124 using a main bearing puck 88. The main bearing puck 88 is located within the rotary release assembly hole 124 of the UPA frame 90, protrudes outward therefrom on the front and rear sides of the UPA frame 90, and includes holes configured to receive the bolts 78. The main bearing puck 88 may contact inner surfaces of the rotary release assembly hole 124 to provide a low friction surface for rotation of the components of the rotary release assembly. Preferably, the main bearing puck 88 is formed of a low-friction, durable material such as but not limited to certain polymeric materials such as an acetal polyoxymethylene resin commercially available under the brand name Delrin® manufactured by DuPont® or similar generic materials (sometimes referred to as Delron).

Between the rotary disc 76 and a rear side of the UPA frame 90, the assembly includes a rotary disc spacer 89 adjacent the rotary disc 76, the medial ends of the rod ends 80 adjacent the rotary disc spacer 89, a rear rotary plate 82 adjacent the medial ends of the rod ends 80, a rear side of the main bearing puck 88 protruding outward from the rear side of the UPA frame 90, a pair of rear washers 84 (e.g., precision ground high micron finish (PGHMF) washers) between the rear rotary plate 82 and the rear side of the main bearing puck 88, and a rear thrust bearing 86 between the pair of rear washers 84. On a front side of the UPA frame 90, the assembly includes a front rotary plate 92 adjacent the assembly nuts 94, a front side of the main bearing puck 88 protruding outward from the front side of the UPA frame 90, a pair of front washers 85 (e.g., PGHMF washers) between the front rotary plate 92 and the front side of the main bearing puck 88, and a front thrust bearing 87 between the pair of front washers 85.

The pair of rear washers 84 and the rear thrust bearing 86 each include central openings that are configured to receive the rear side of the main bearing puck 88, and the pair of front washers 85 and the front thrust bearing 87 each include central openings that are configured to receive the front side of the main bearing puck 88. Likewise, the main bearing puck 88 preferably extends from the UPA frame 90 to an extent sufficient to receive the pair of rear washers 84 and the rear thrust bearing 86 on the rear side of the UPA frame 90 and the pair of front washers 85 and the front thrust bearing 87 on the front side of the UPA frame 90. Therefore, when the assembly is secured with the assembly bolts 78 and the assembly nuts 94, the rear rotary plate 82 is in direct physical contact with the rear side of the main bearing puck 88 and an outermost of the pair of rear washers 84, and the front rotary plate 92 is in direct physical contact with the front side of the main bearing puck 88 and an outermost of the pair of front washers 85. Similarly, the rear side of the UPA frame 90 is in direct contact with an innermost of the pair of rear washers 84, and the front side of the UPA frame 90 is in direct contact with an innermost of the pair of front washers 85.

Preferably, the UPA 73 is configured such that it is capable of being moved upwards along the rails 50 (i.e., away from the weight bench 206) without rotating the rotary release assembly by applying an upward force to the UPA 73, for example, by pushing upwards on the lower pad 123. For example, the slots 54 of the locking plates 56 may in combination define a repeating pattern of alternating horizontal and upward angled surfaces (e.g., a sawtooth pattern with a zero rake angle) wherein upper surfaces of the slots 54 define the angled surfaces and lower surfaces of the slots 54 define the horizontal surfaces. While the lateral ends of the locking fingers 96 are located in the slots 54, upper surfaces of the locking fingers 96 are configured to contact the angled surfaces and lower surfaces of the locking fingers 96 are configured to contact the horizontal surfaces.

In such an embodiment, an upward force on the UPA 73 causes the locking fingers 96 to contact the angled surfaces and slide inward (i.e., medial direction) until the locking fingers 96 laterally pass peaks of the repeating pattern (i.e., medial ends of the angled surfaces) and are able to move upward into the next consecutive valleys (e.g., the slots 54) of the repeating pattern. Notably, the upward force applied to the UPA 73 must be sufficient to overcome the springs 102 as the locking fingers 96 slide along the angled surfaces to entirely pass the peaks of the repeating pattern. Once the locking fingers 96 are able to move upwards into the next consecutive valleys, the springs 102 will cause the locking fingers 96 to be automatically inserted therein, that is, into the next slots 54 of the locking plates 56.

In contrast, the UPA 73 is preferably incapable of downward movement along the rails 50 (i.e., toward the weight bench 206) without rotating the rotary release assembly, regardless of a downward force applied to the UPA 73. Specifically, since the lower surfaces of the locking fingers 96 are in contact with the horizontal surfaces of the slots 54, a downward force does not cause the locking fingers 96 to slide inward (i.e., medial direction). Instead, the horizontal surfaces act as barriers that restrict downward movement of the UPA 73.

In addition, or as an alternative, upper corners of the lateral ends of the locking fingers 96 may be rounded or beveled such that an upward force on the UPA 73 causes the locking fingers 96 to slide inward (i.e., medial direction), and lower corners of the lateral ends of the locking fingers 96 may lack sufficient rounding or beveling to cause inward sliding in response to a downward force.

Figure 14:
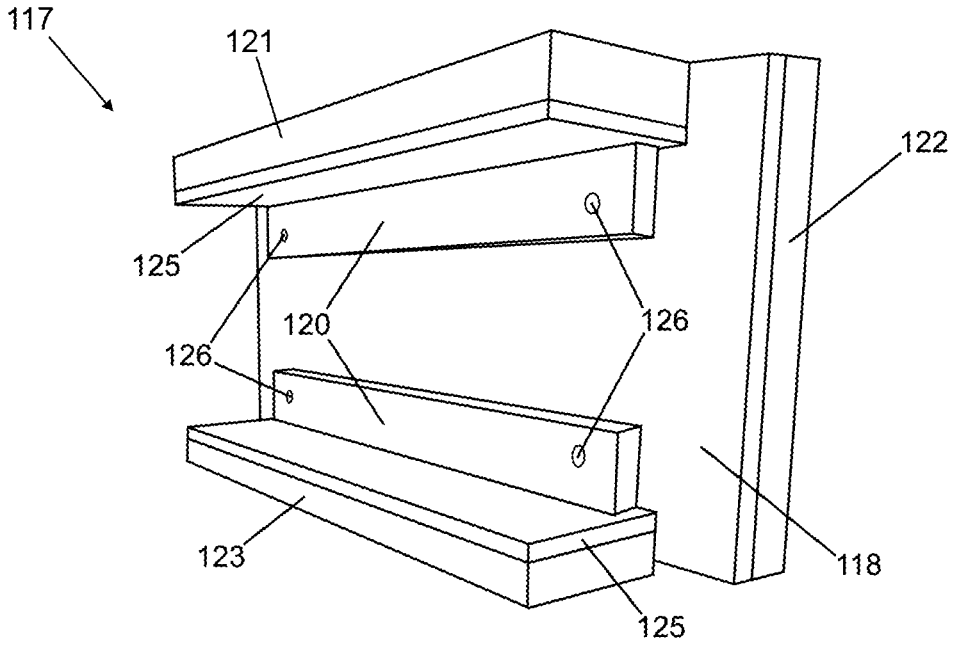
FIG. 14 is a perspective view of a back side of a front pad component of the user's platform armrest of the strength training apparatus of FIG. 1.
Figure 15:
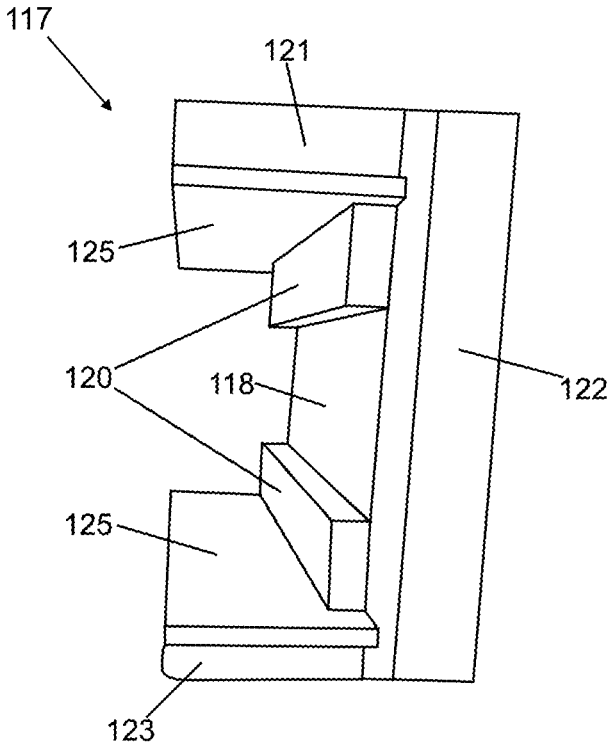
FIG. 15 is an end view of the front pad component of FIG. 14.

FIGS. 14 through 21 illustrate external components of the UPA 73 and certain nonlimiting method steps for their assembly to the UPA frame 90. As seen in FIGS. 14 and 15, the front pad component 117 includes a frame having a main member 118, build out members 120 extending longitudinally along upper and lower edges of the main member 118 and protruding from a rear surface of the main member 118, and end members 125 fixed to upper and lower edges of the main member 118. The front pad 122 is fixed to and covers a front surface of the main member 118 and the upper and lower pads 121 and 123 are fixed to and cover outer surfaces of the end members 125. The build out members 120 include multiple holes 126 that have embedded therein threaded wood insert nuts each configured to receive a corresponding threaded bolt and secure such bolts to the front pad component 117.

Figure 16:
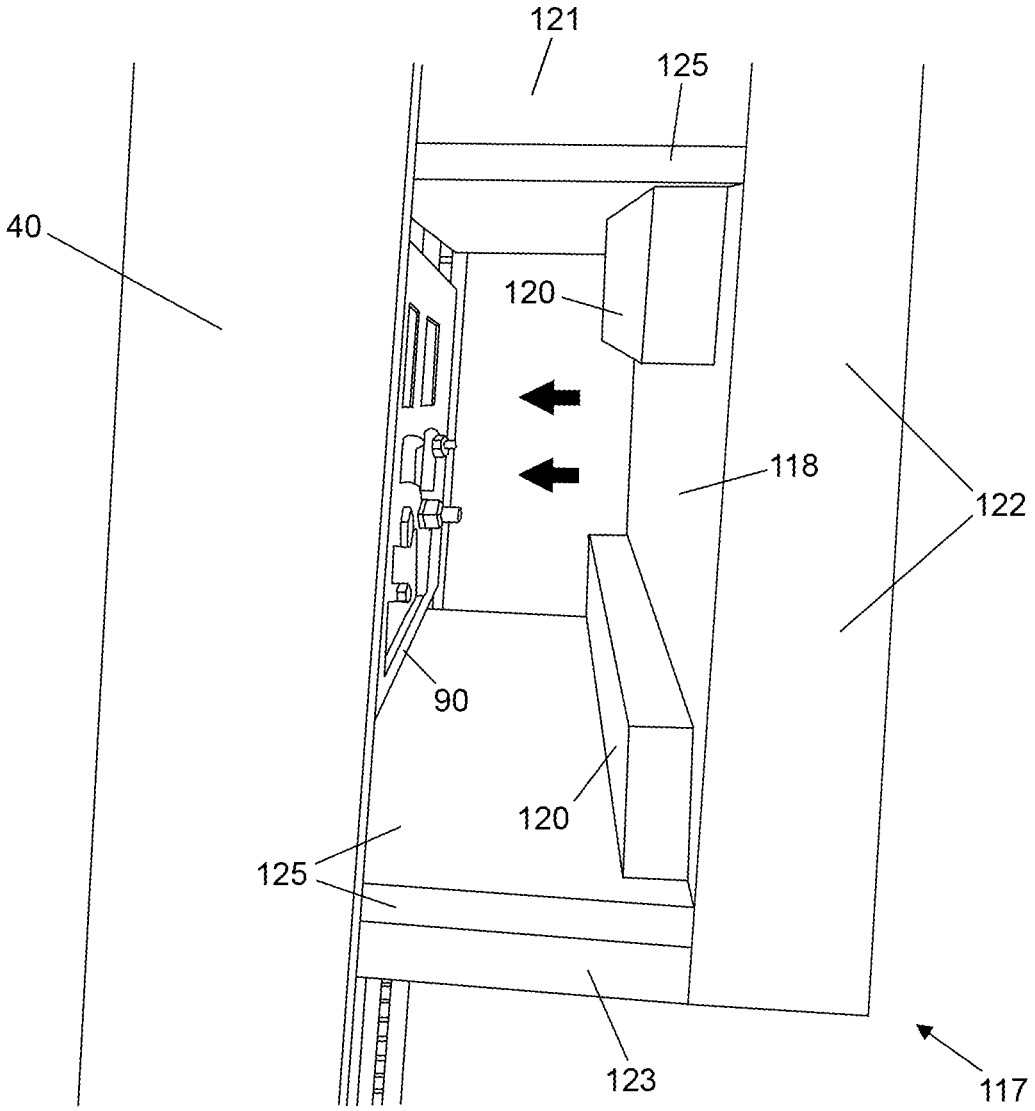
FIG. 16 illustrates a nonlimiting method for installing the front pad component of FIG. 14 onto the strength training apparatus of FIG. 1.

FIG. 16 illustrates the front pad component 117 being assembled with the UPA frame 90. As represented, the front pad component 117 is capable of being positioned such that the UPA frame 90 is located between the end members 125 and distal ends of the front pad component 117 overlap the swing arms 40. The front pad component 117 may then be positioned such that the build out members 120 directly contact the front side of the UPA frame 90 and the holes 126 of the build out members 120 align with slots 128 of the UPA frame 90. Preferably, the build out members 120 protrude from the main member 118 to an extent sufficient such that a recess or open space defined between edges of the build out members 120 is able to receive portions of components, such as portions of the rotary release assembly, that protrude from the front side of the UPA frame 90 without such components contacting the main member 118 of the front pad component 117.

Figure 17:
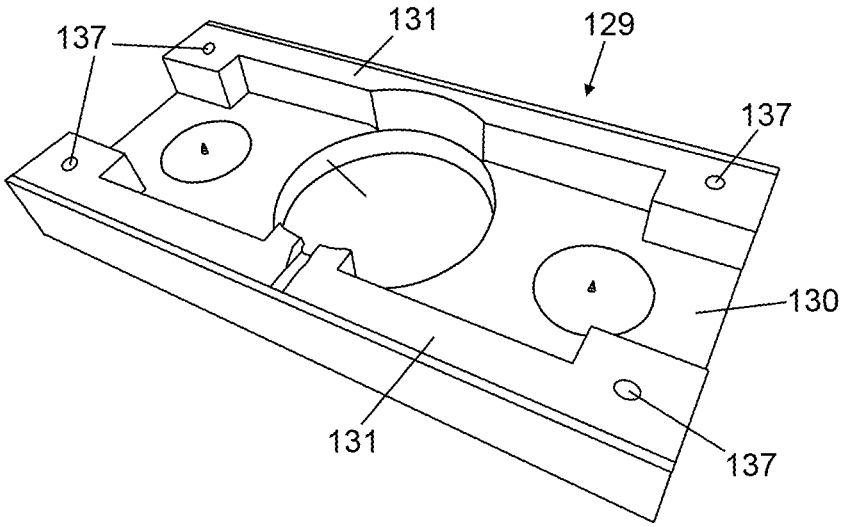
FIG. 17 is a perspective view of a back side of a rear pad base component of the user's platform armrest of the strength training apparatus of FIG. 1.
Figure 18:
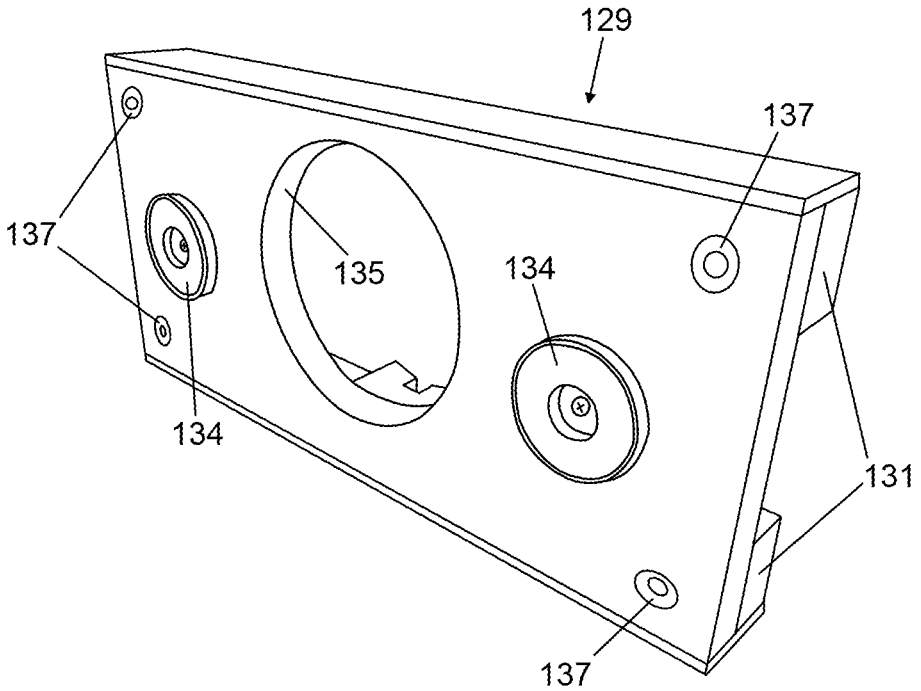
FIG. 18 is perspective view of a front side of the rear pad base component of FIG. 17.

In FIGS. 17 and 18, the rear pad base component 129 includes a frame having a main member 130, build out members 131 extending longitudinally along upper and lower edges of the main member 130 and protruding from a front surface of the main member 130, a rotary release assembly base hole 135, and magnets 134 fixed to a rear surface of the main member 130. The build out members 131 include multiple through-holes 137.

Figure 19:
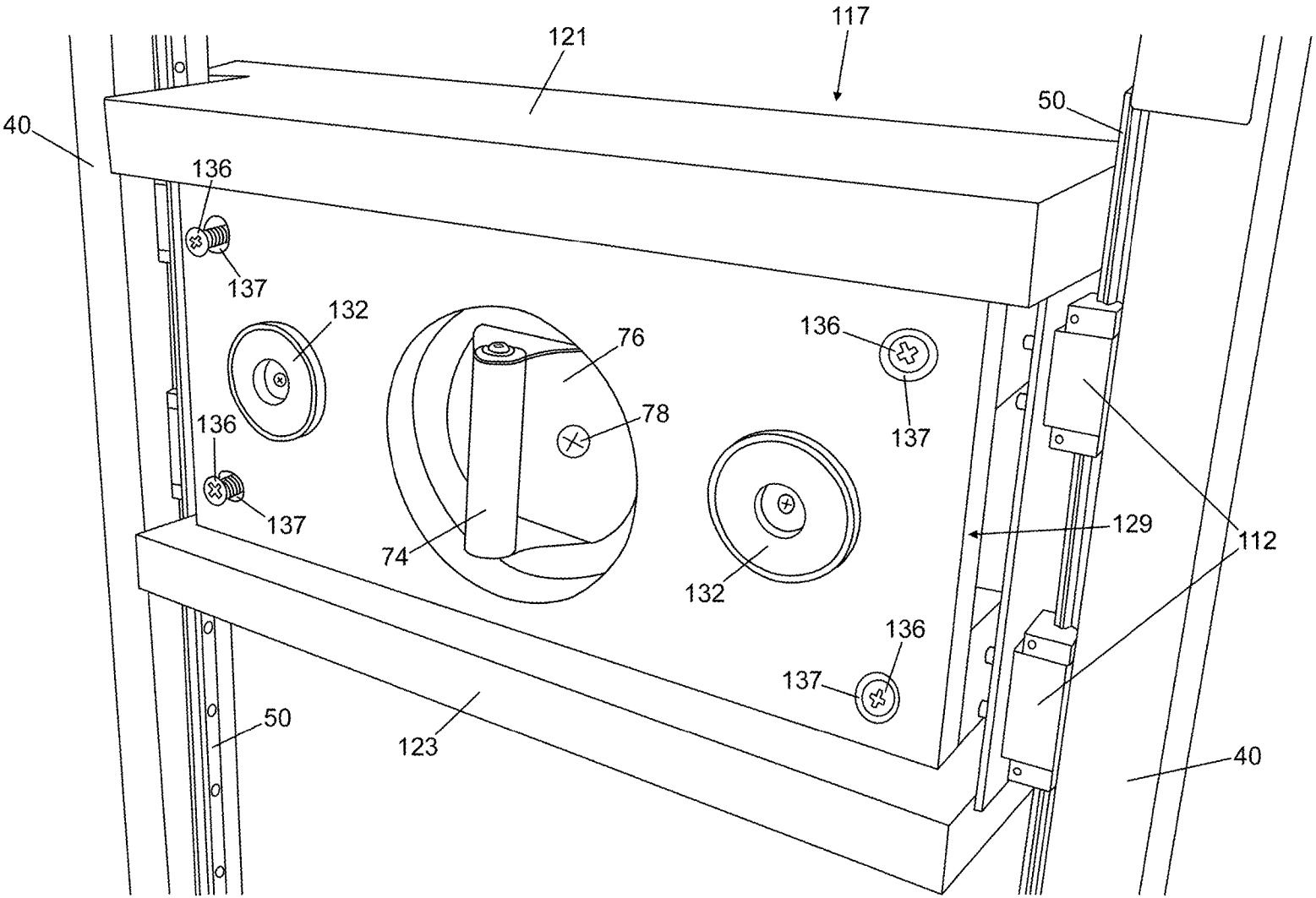
FIG. 19 illustrates a nonlimiting method for installing the rear pad base component of FIG. 17 onto the strength training apparatus of FIG. 1.

FIG. 19 illustrates the rear pad base component 129 being assembled with the UPA frame 90. As represented, the rear pad base component 129 is capable of being positioned such that the rear pad base component 129 is located between the end members 125 of the front pad component 117, and such that the build out members 131 directly contact the rear side of the UPA frame 90 and the holes 137 of the build out members 131 align with slots 128 of the UPA frame 90. Preferably, the build out members 131 protrude from the main member 130 to an extent sufficient such that a recess or open space defined between edges of the build out members 131 is able to receive portions of components, such as the rod ends 80, locking fingers 96, and guide plates 98, that protrude from the rear side of the UPA frame 90 without such components contacting the main member 130 of the rear pad base component 129.

Bolts 136 are shown inserted through the holes 137 of the rear pad base component 129, through the slots 128 of the UPA frame 90, and into the holes 126 of the front pad component 117. The bolts 136 are shown as threaded into the threaded wood insert nuts located in the holes 126 to thereby secure the front pad component 117 and the rear pad base component 129 to the UPA frame 90.

Figure 20:
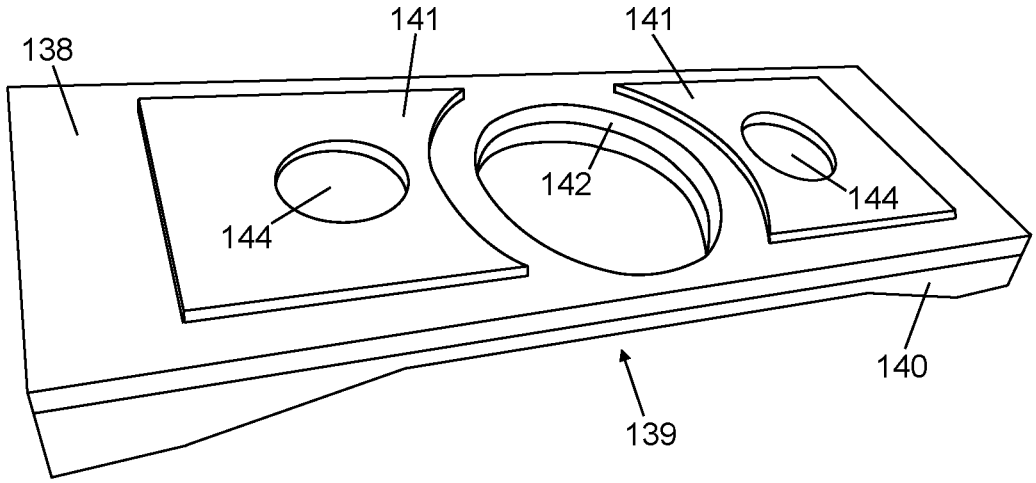
FIG. 20 is a perspective view of a back side of a rear pad component of the user's platform armrest of the strength training apparatus of FIG. 1.
Figure 21:
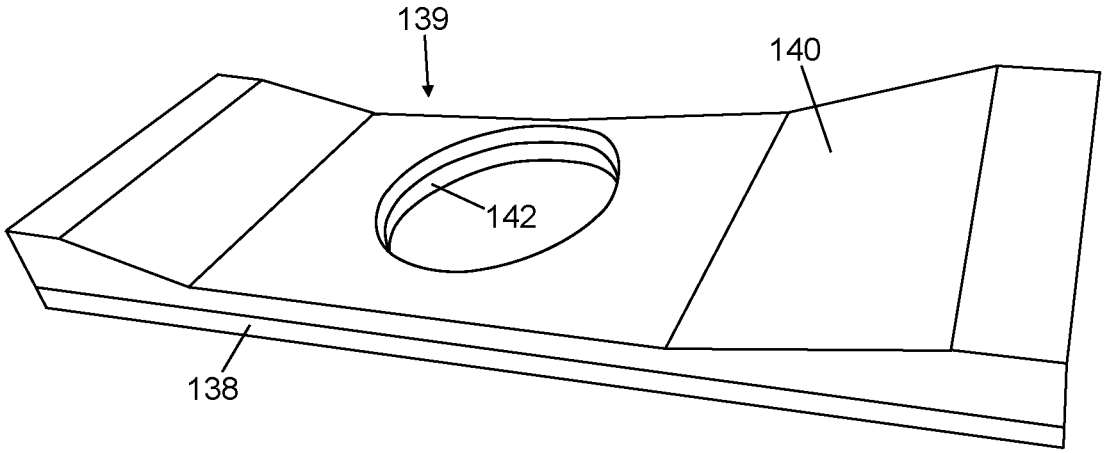
FIG. 21 is a perspective view of a front side of the rear pad component of FIG. 20.

As seen in FIGS. 20 and 21, the rear pad component 139 includes a frame having a main member 138, build out members 141 protruding from a front surface of the main member 138, a rotary release assembly component hole 142, and magnets 144 fixed to a front surface of the main member 138. The rear pad 140 is fixed to and covers a rear surface of the main member 138.

The rear pad component 139 is capable of being assembled with the UPA frame 90 by positioning the rear pad component 139 such that the build out members 141 and the magnets 144 directly contact the rear surface of the main member 130 and the magnets 134, respectively, of the rear pad base component 129. In the represented embodiment, the magnets 134 of the rear pad base component 129 protrude therefrom and the magnets 144 of the rear pad component 139 are located in recesses configured to receive the magnets 134. When the magnets 134 and 144 are coupled, edges of the recesses preferably prevent the sliding of the components relative to one another thereby improving the coupling. In this position, the rear pad component 139 is capable of being located at least partially between the end members 125 of the front pad component 117. Preferably, the build out members 141 protrude from the main member 138 to an extent sufficient such that recesses or open space defined between edges of the build out members 131 and ends of the main member 138 are able to receive and overlap portions of the swing arms 40 without the swing arms 40 contacting the rear pad component 139.

The front, rear, upper, and lower pads 122, 140, 121, and 123 may have various exterior surface shapes. In the embodiment represented in the figures, the front, upper, and lower pads 122, 121, and 123 have relatively planar surfaces. In contrast, the rear pad 140 includes a curved, convex surface intended to ergonomically cup elbows of a user. It is believed that this concave surface of the rear pad 140 may assist in retaining a user's elbows more closely in line with the width of their shoulders as opposed to flaring outward laterally while performing lying triceps extensions against the rear pad 140.

The UPA 73 may also include lateral supports on each side thereof to serve as side braces for the user's arms to rest against, laterally. These supports may be fixed at the outer edges of the UPA 73, or they may be laterally adjustable allowing them to be spaced closer together or further apart. In addition, the front, rear, upper, and lower pads 122, 140, 121, and 123 could differ in structure from one another since they are intended to be used for different exercises (i.e., triceps extensions vs. biceps curls). For example, the front pad 122 (biceps curling side) could include thicker padding than the rear pad 140 (triceps extension side). As another example, the upper and lower pads 121 and 123 may include rounded padding buildup for user comfort, for example, when doing biceps curling exercises.

The training bench 10 allows the user to lie on his or her back (supine) below and/or underneath a suspended platform (i.e., the UPA 73). The user may contact the rear pad 140 with posterior portions of the user's arms between the shoulder and elbow and bend and extend their arms at the elbow while holding free weights (e.g., perform triceps extensions or skull crushing exercises) in order to train their triceps. Unlike other exercise machines, the training bench 10 provides a mechanism for positioning and fixating the upper arm(s) while doing free weight triceps extensions on basic weight benches.

FIGS. 22 through 33 schematically represent various aspects of another embodiment of a training bench 1010 in accordance with certain aspects of the invention. In these figures, consistent reference numbers are used to identify the same elements, but with a numerical prefix (10) added to distinguish the second embodiment from the first embodiment of FIGS. 1 through 21. In view of similarities between the first and second embodiments, the following discussion of the second embodiment will focus primarily on aspects of the second embodiment that differ from the first embodiment in some notable or significant manner. Other aspects of the second embodiment not discussed in any detail can be, in terms of structure, function, materials, etc., essentially as was described for the first embodiment.

Figure 23:
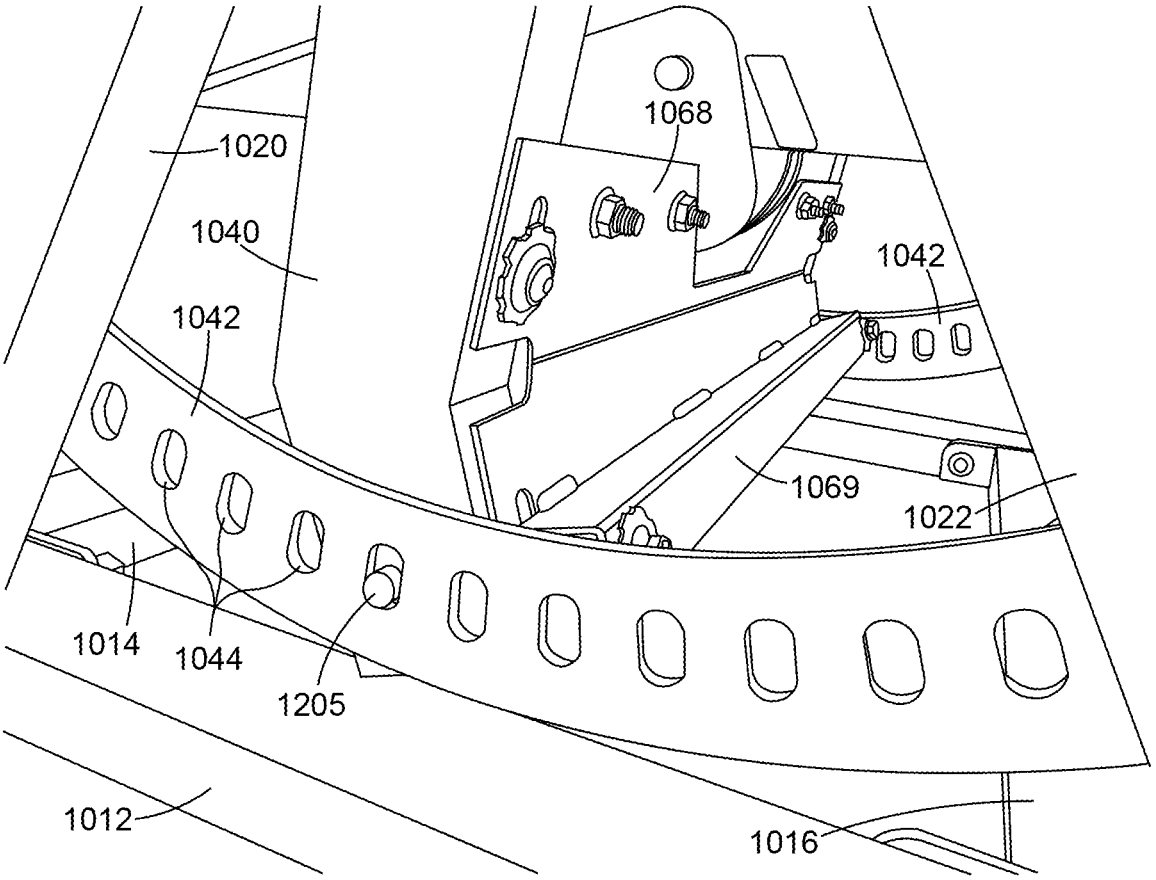
FIG. 23 is an enlarged view of a selector plate of the strength training apparatus of FIG. 22.

As seen in FIG. 23, the training bench 1010 includes selector plates 1042 for securing the swing arms 1040 which omit the guide slots 228 of the first embodiment. In addition, a kickplate stability bar 1069 is secured to and extends laterally across a front side of the kickplate 1068 between ends thereof to promote increased support and rigidity to the swing arms 1040.

Figure 24:
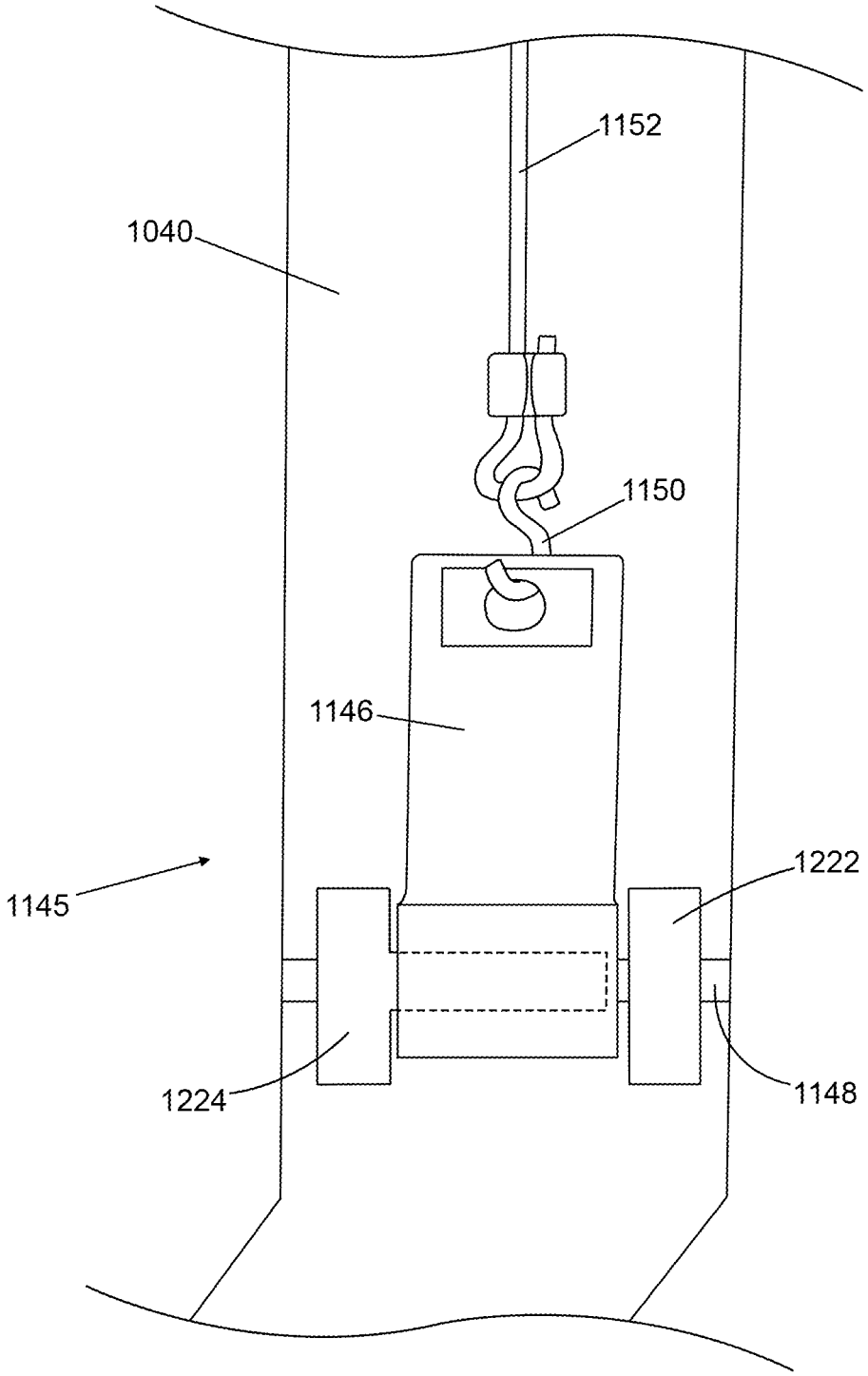
FIG. 24 is a cutaway side view of a portion of a counter balance system of the strength training apparatus of FIG. 22.
Figure 25:
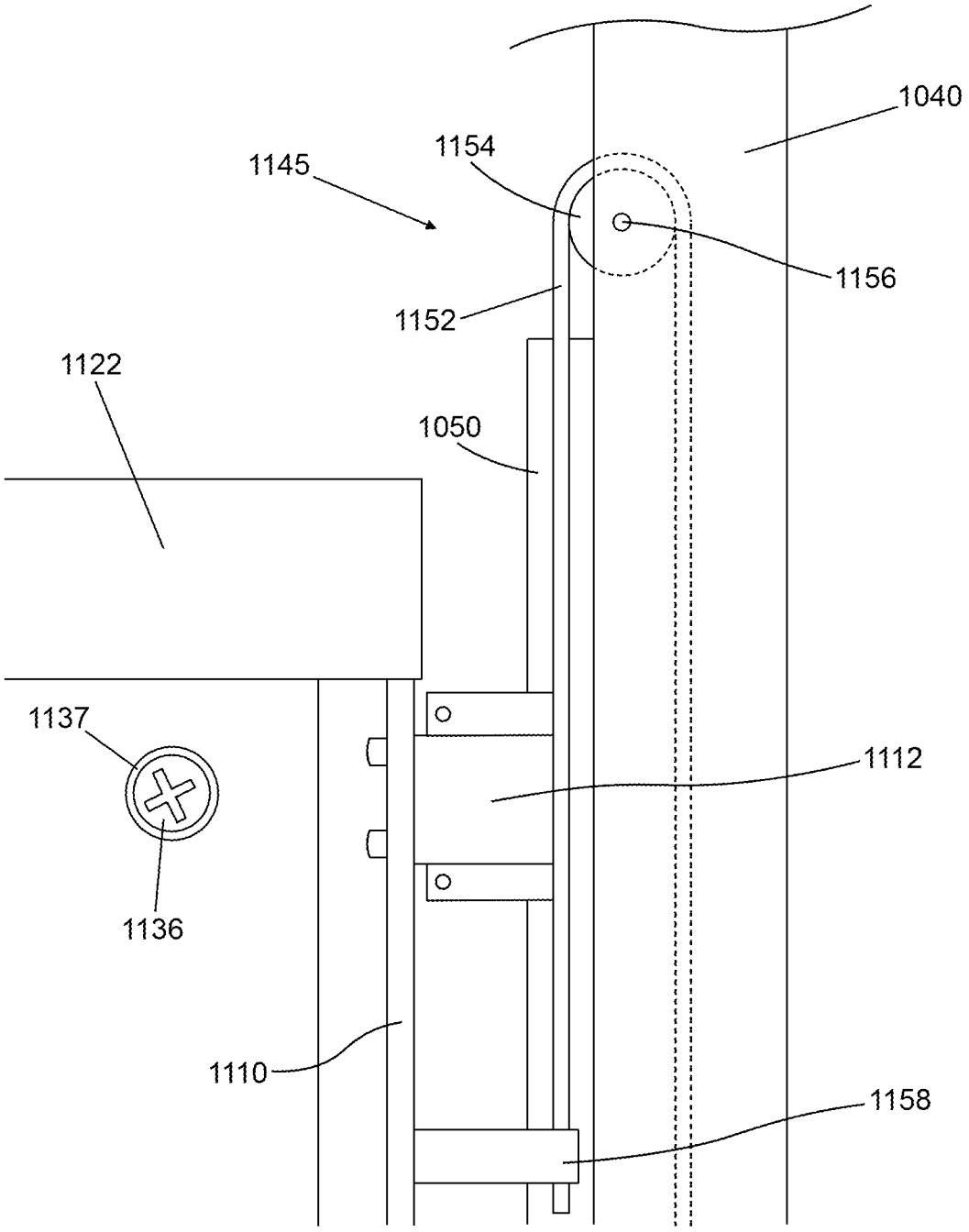
FIG. 25 is a cutaway side view of another portion of the counter balance system of the strength training apparatus of FIG. 22.
Figure 26:
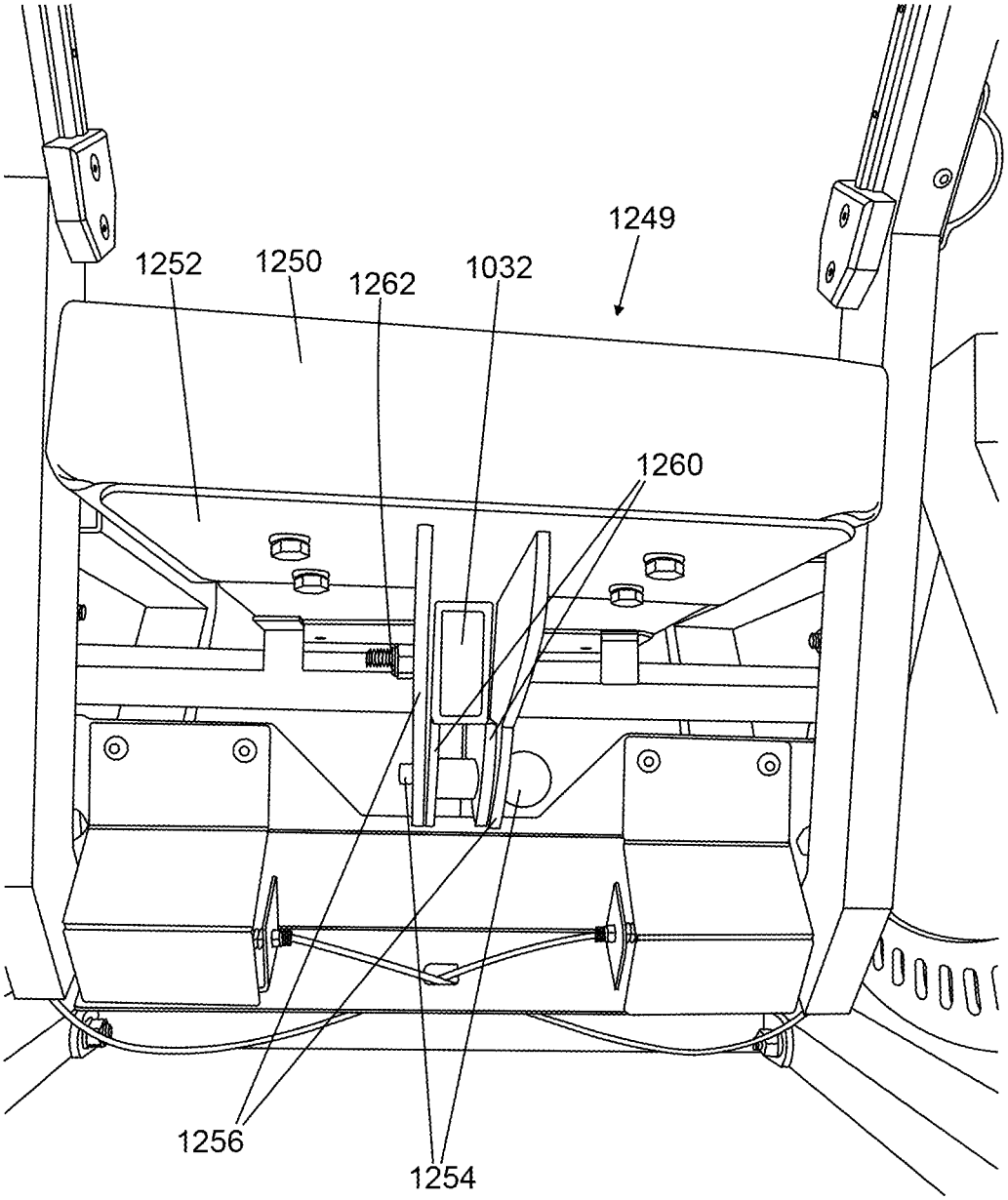
FIG. 26 is a rear end perspective view of an adjustable head pad of the strength training apparatus of FIG. 22.
Figure 27:
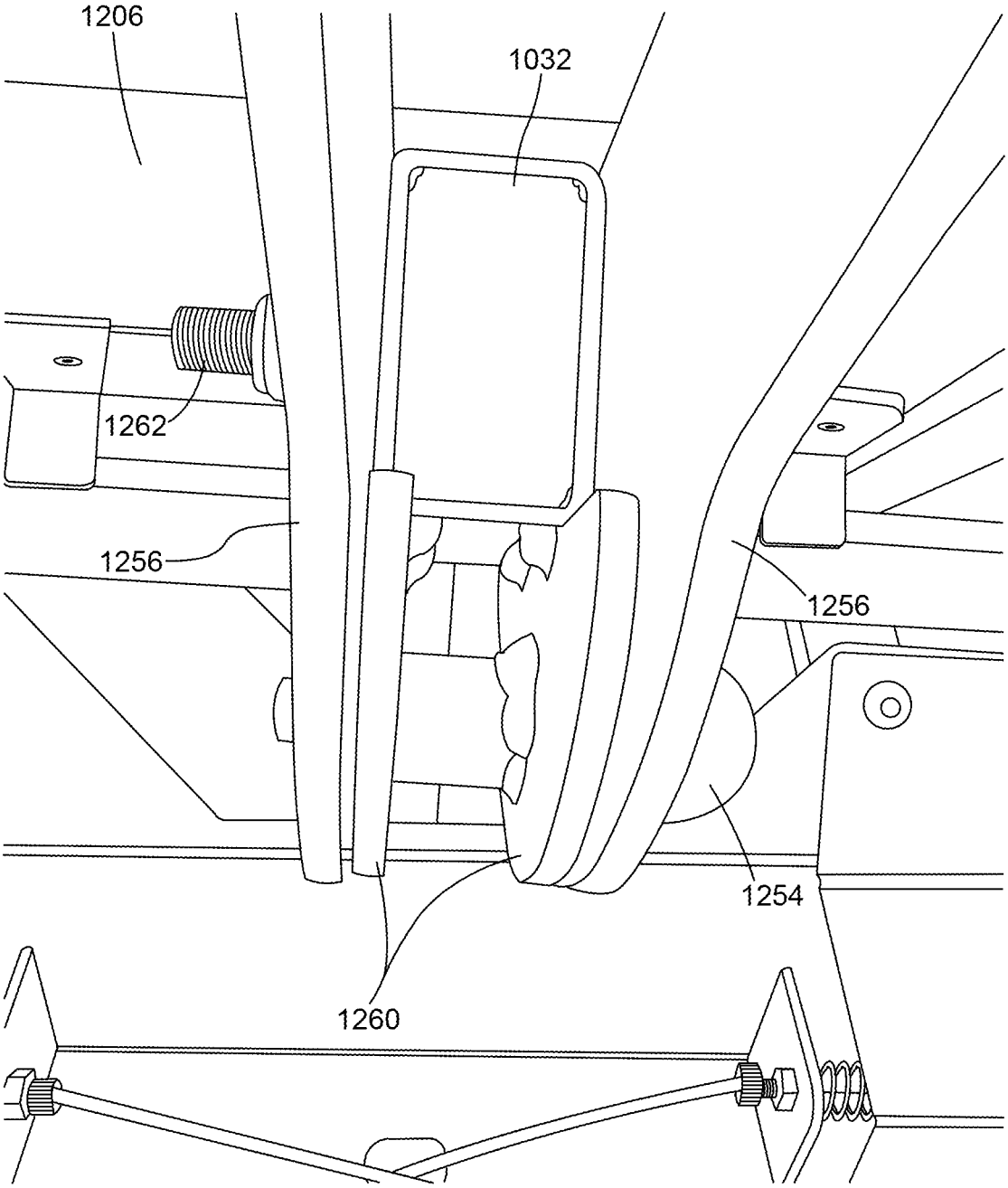
FIG. 27 is an enlarged perspective rear view of an adjustment system for the head pad of FIG. 26.
Figure 28:
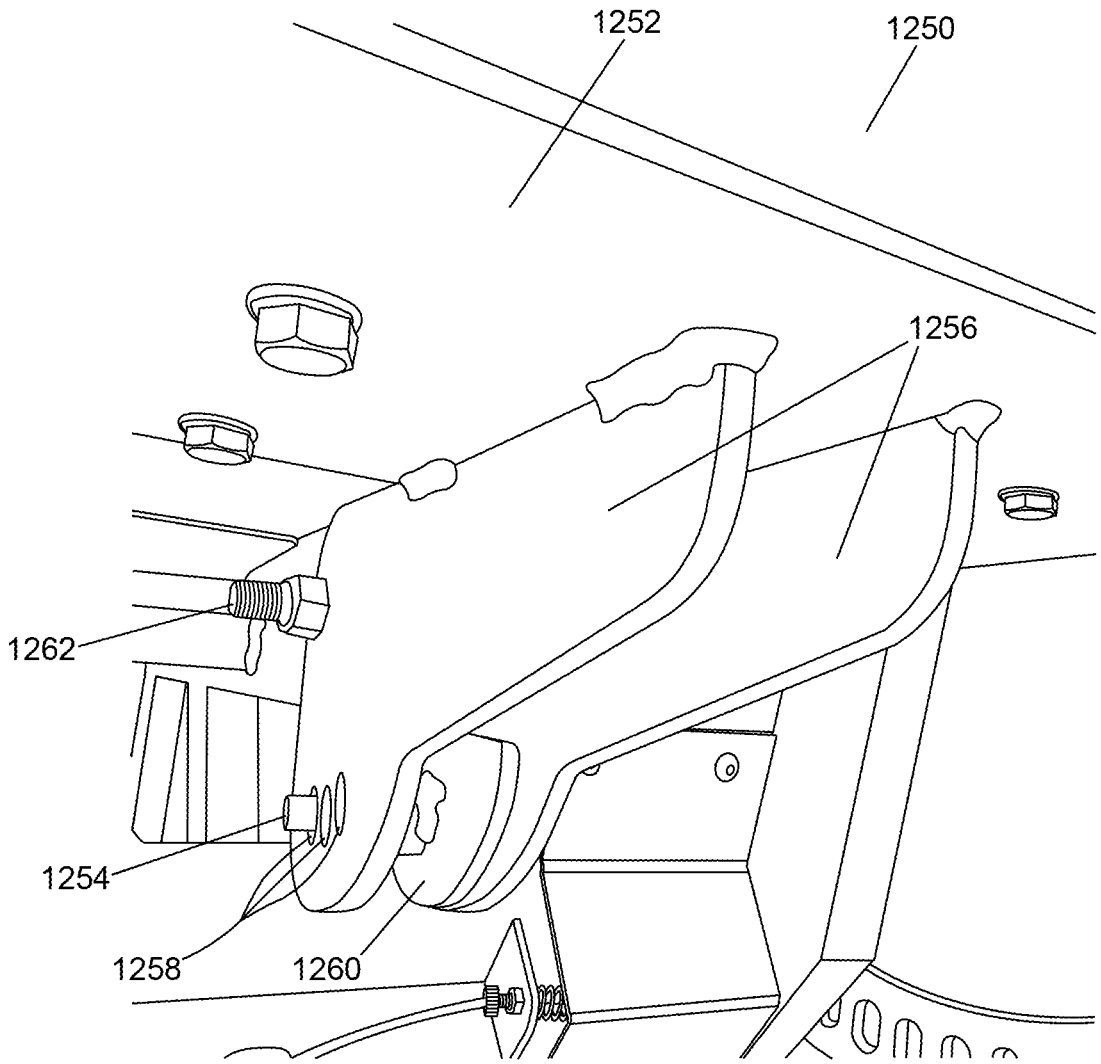
FIG. 28 is an enlarged left perspective view of the adjustment system shown in FIG. 27.
Figure 29:
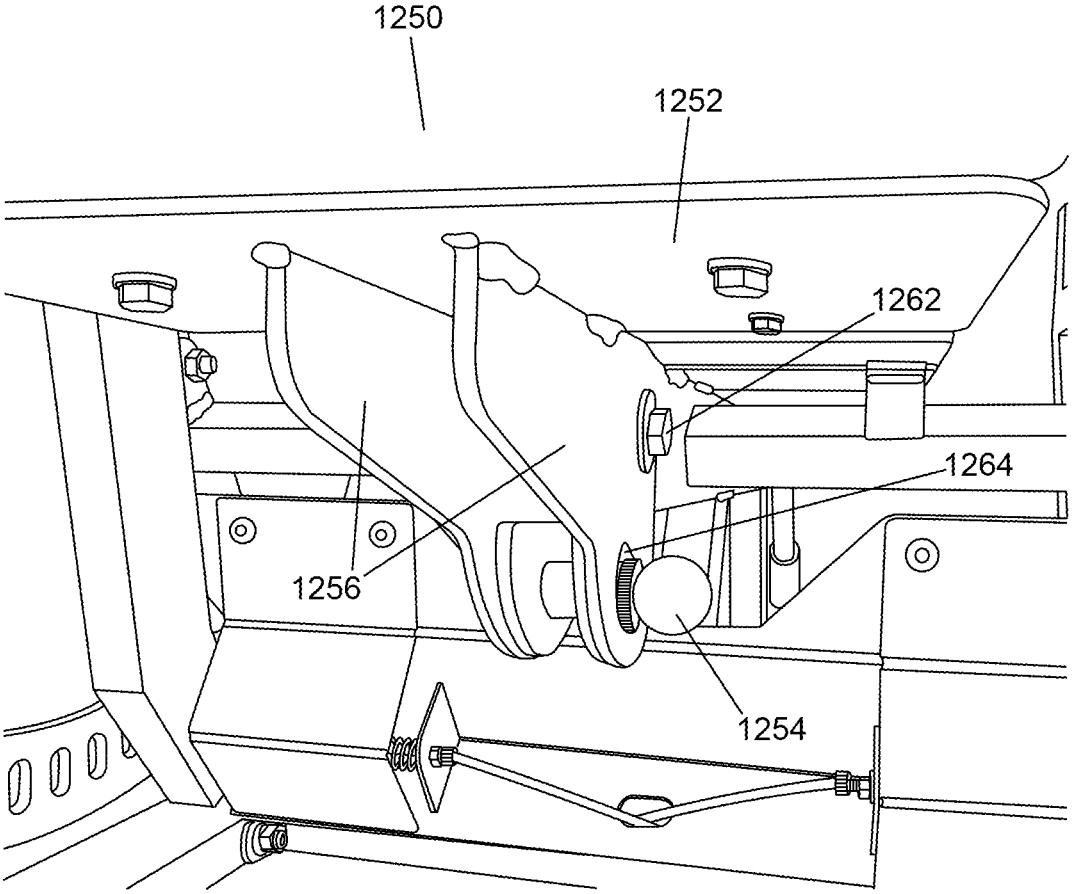
FIG. 29 is an enlarged right perspective view of the adjustment system shown in FIG. 27.

The training bench 1010 includes a counter balance system 1145 intended to reduce the load required to manually adjust the position of the UPA 1073. FIGS. 24 and 25 illustrate aspects of a nonlimiting counter balance system 1145 that includes biasing members, such as constant force springs 1146, that are secured to fixed points within each of the swing arms 1040 about axles 1148. The constant force springs 1146 are preferably located below lower ends of the rails 1050 and locking plates 1056. The springs 1146 may be, for example, pre stressed flat strips of spring material which form into constant radius coils around themselves or on a drum. The constant force springs 1146 may include spacers 1222 and 1224 to maintain preferred positioning and promote smooth coiling and uncoiling of the springs 1146 and thereby reduce the likelihood of binding. Other types of biasing members could be used with or in lieu of the springs 1146.

Figure 22:
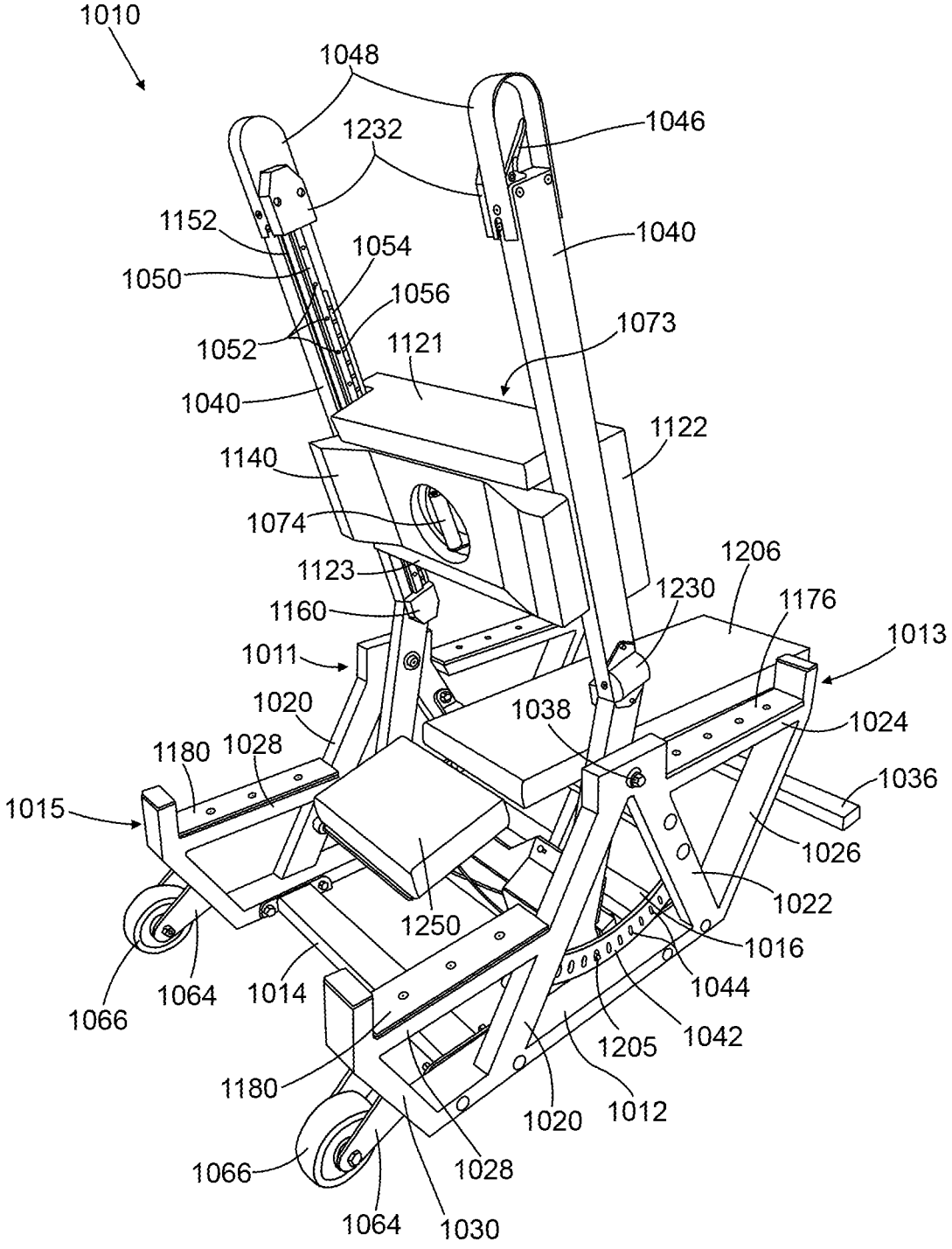
FIG. 22 is a right rear perspective view of a strength training apparatus in accordance with a second nonlimiting embodiment of this invention.

Upper ends of the springs 1146 are connected to a cable pulley system that includes cables 1152 coupled to the springs 1146 with, for example, an attachment hook 1150. The cables 1152 are routed from the springs 1146, over distal ends of the swing arms 1040 or over pulleys therein, and routed back downward where they are coupled to the UPA frame 1090. In the represented embodiment, the cables 1152 are routed over pulleys 1154 that are rotatably coupled to the swing arms 1040 at axles 1156 with spacers (not shown) on sides thereof, routed downward along a medial exterior of the swing arms 1040, and coupled to an attachment member 1158 of the UPA frame 1090. The pulleys 1154 are preferably located above upper ends of the rails 1050 and the locking plates 1056. The swing arms 1040 may include internal cable guides (not shown) to support and guide the cables 1152 and biasing members, such as constant force springs 1146, within the swing arms 1040 and thereby reduce the likelihood of the cables 1152 and constant force springs 1146 interacting with other components therein, such as screws or other fasteners. Spring covers 1230 and pulley covers 1232 may be included to cover and protect the springs 1146 and the pulleys 1154, respectively (FIG. 22). Pulley covers 1232 may also serve as upper end stoppers to limit how high the UPA 1073 can go.

The counter balance system may effectively counterbalance the weight of the UPA 1073 promoting ease of movement thereof as well as reducing the likelihood of the UPA 1073 descending too abruptly. In certain embodiments, these constant force springs 1146 may provide sufficient counter balance forces to reduce a net weight of the UPA 1073 by 80 percent or more, for example, from about 22 lbs. (about 10 kg) to about 3 lbs. (about 1.4 kg) or less.

FIGS. 26 through 29 show various aspects of an adjustable headrest 1249 of the training bench 1010 of FIG. 22. The headrest 1249 includes a head pad 1250 that is pivotable between a first position that is substantially level with the remainder of the weight bench 1206 and at least a second position that is lower than the remainder of the weight bench 1206. The head pad 1250 is secured atop a head pad frame 1252 that includes a pair of vertical head pad braces 1256. The head pad braces 1256 rotatably couple the head pad frame 1252 with a bolt 1262 to flanges 1260 extending from a rear end of the weight bench support member 1032. The flanges 1260 house a pop pin 1254. The head pad braces 1256 flank lateral sides of the flanges 1260. The pop pin 1254 includes a head that extends from the flanges 1260 through a slot 1264 in a first of the head pad braces 1256 and a distal end that extends from the flanges 1260 into one of multiple holes 1258 in a second of the head pad braces 1256.

The head pad 1250 may be positioned in multiple positions by pulling the pop pin 1254 outward such that the distal end thereof clears the holes 1258 and rotating the head pad 1250 about the bolt 1262 to one of multiple positions (e.g., flat or zero degrees, that is, level with the weight bench 1206, downward fifteen degrees, or downward thirty degrees).

Figure 30:
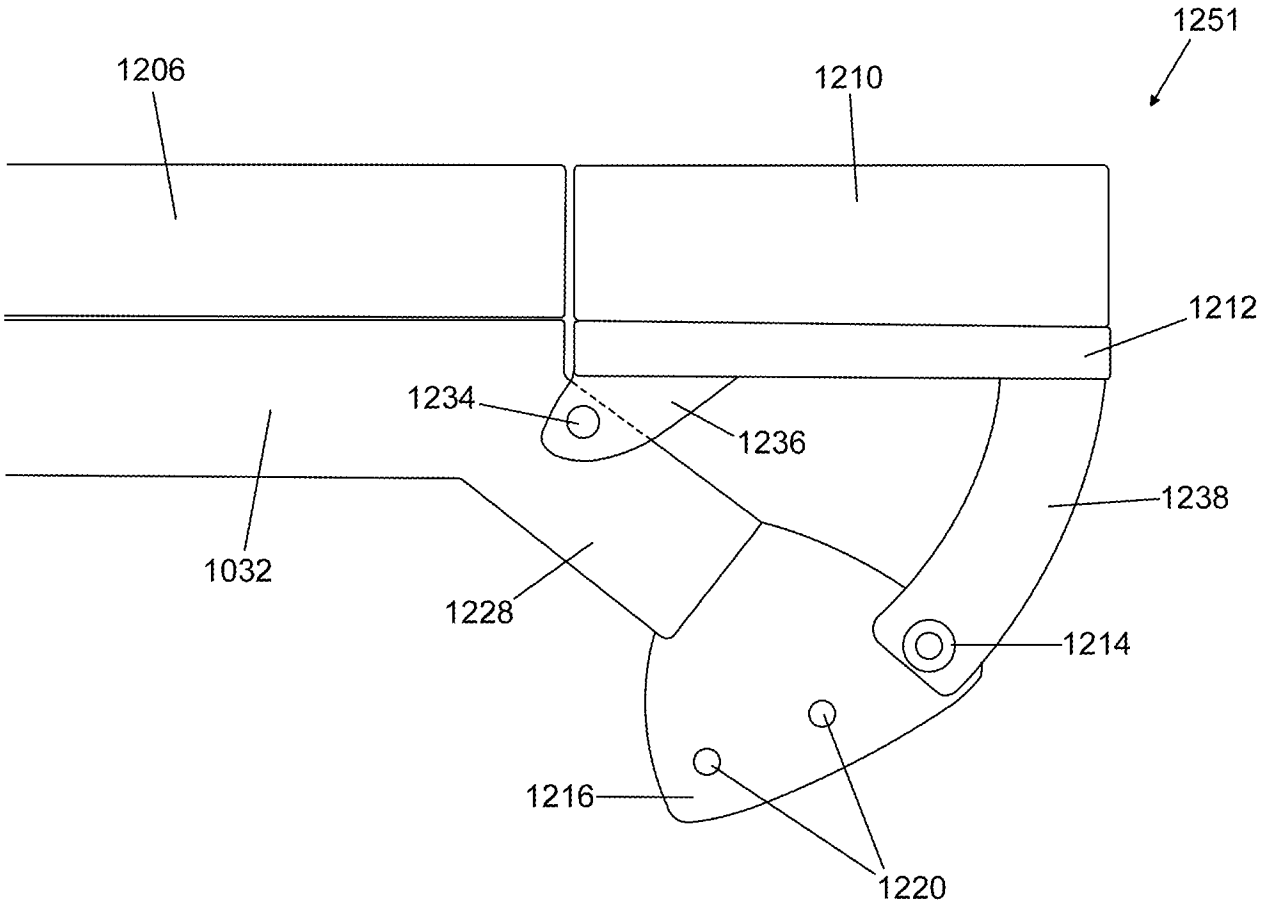
FIG. 30 is an enlarged side view of an alternative head pad assembly for the strength training apparatus of FIG. 22 shown in a first adjustment position.
Figure 31:
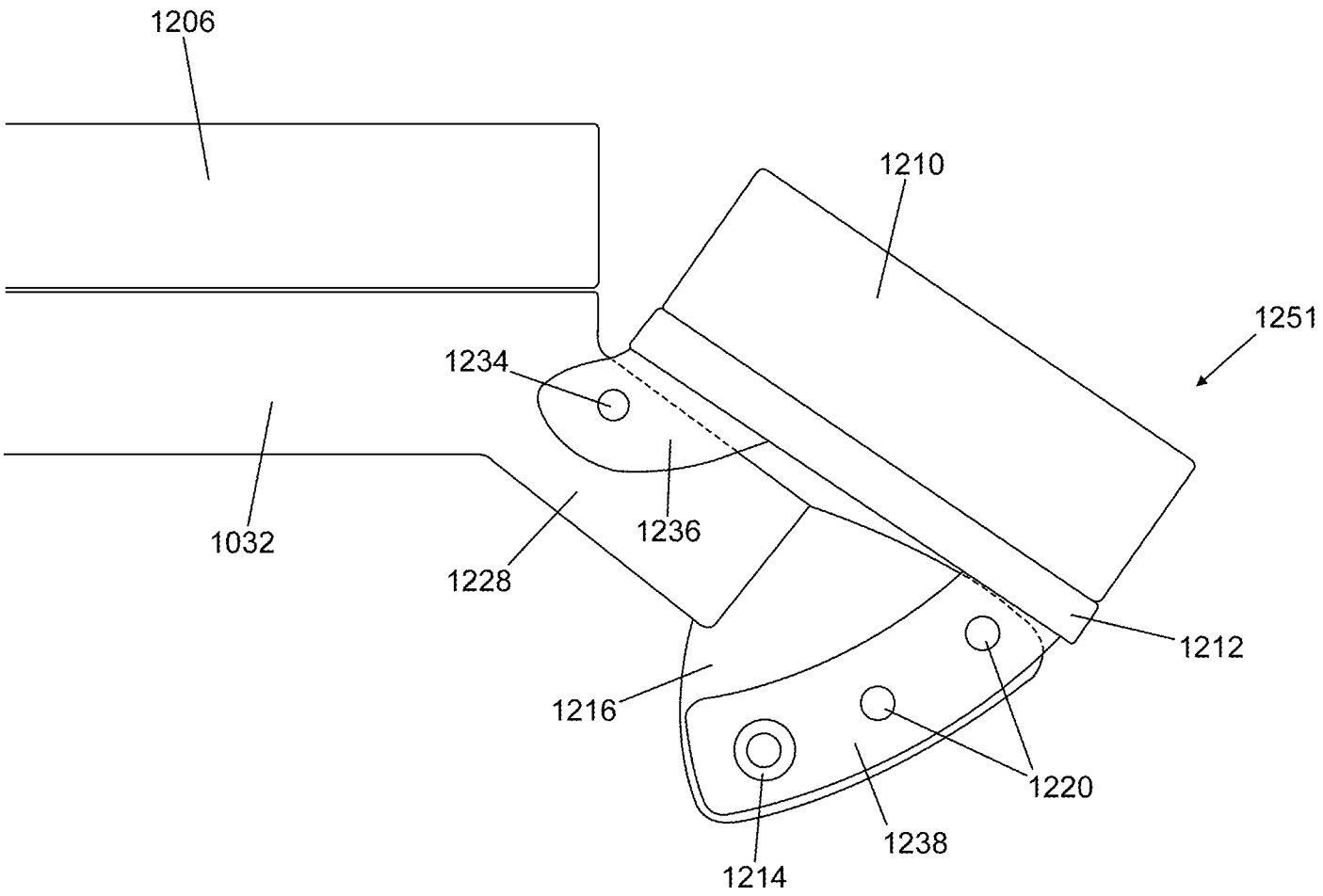
FIG. 31 is an enlarged side view of the alternative head pad of FIG. 30 shown in a second adjustment position.
Figure 32:
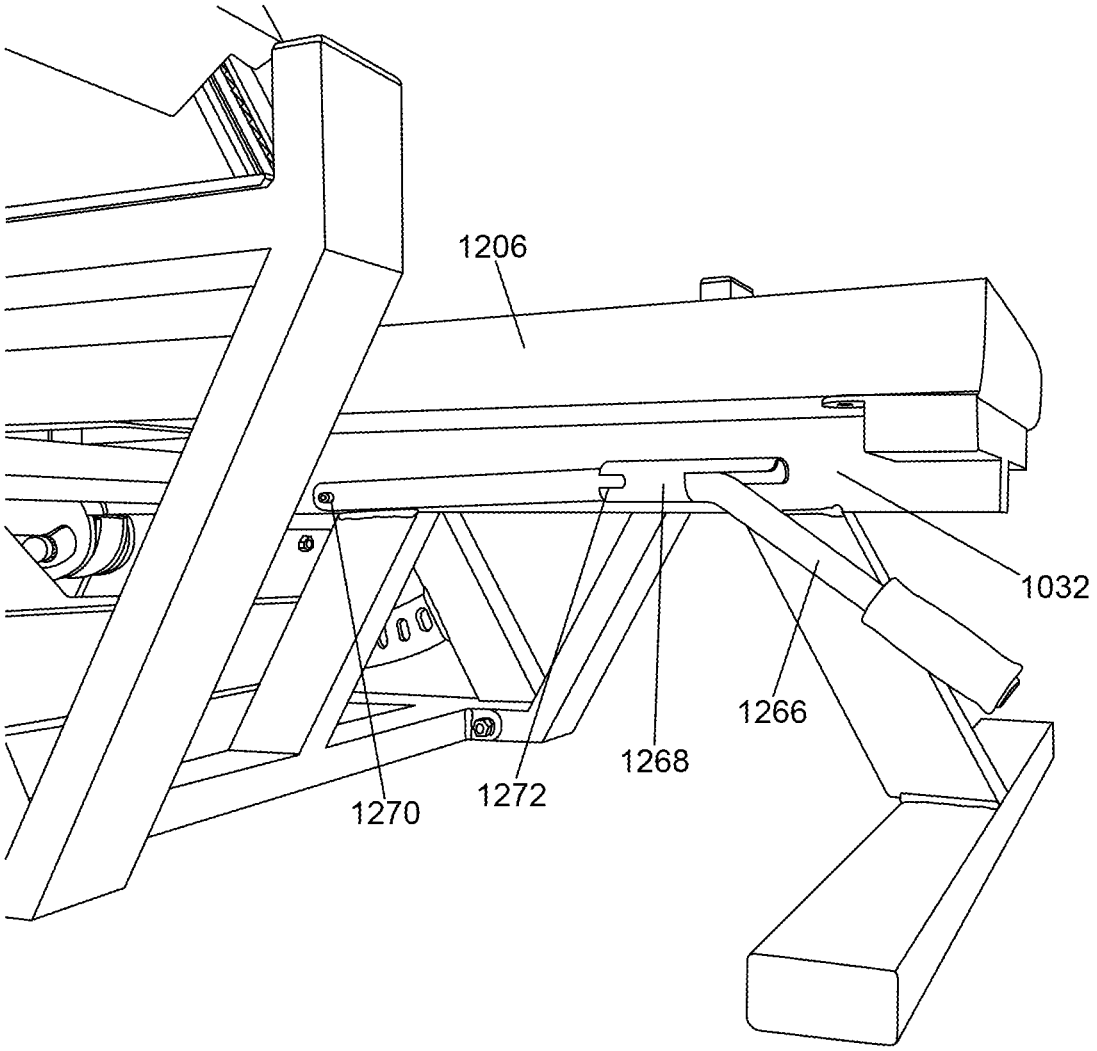
FIG. 32 is right side perspective view of a moving handle of the strength training apparatus of FIG. 22.

FIGS. 30 and 31 schematically represent a headrest 1251 that may be provided as an alternative for the headrest 1249 of FIGS. 26 through 29. In this example, the weight bench support member 1032 includes an angled portion 1228 fixed to a selector plate 1216. A head pad 1210 of the headrest is coupled to a head pad frame 1212 that includes a bracket 1236 coupled to the angled portion 1228 at a pivot joint 1234, and a curved selector flange 1238 with a manual, spring loaded pull pin 1214. The selector plate 1216 includes multiple holes 1220 which are equidistant from the pivot joint 1234. The flange 1238 is configured such that as the head pad 1210 is pivoted about the pivot joint 1234, the pull pin 1214 travels between and is aligned with the holes 1220 of the selector plate 1216. The pull pin 1214 is biased in a direction toward the selector plate 1216, and is capable of being selectively inserted and mated with one of the holes 1220 to allow for the head pad 1210 to be secured at varying angles. The holes 1220 are preferably spaced apart from one another to allow an upper surface of the head pad 1210 to be positioned at various predetermined angles, for example, ranging from approximately zero to fifty degrees from horizontal toward the bottom of the training bench 1010.

It is believed that positioning the head pad 1210 or 1250 below horizontal may allow a user to achieve a larger range of motion when performing lying triceps extension exercises, especially when using the training bench 1010 with the UPA 1073 positioned closer to vertical (e.g., five, ten, and fifteen degrees from vertical). It is believed that having a larger range of motion allows for greater stimuli for adaptions regarding strength and muscle hypertrophy.

Figure 33:
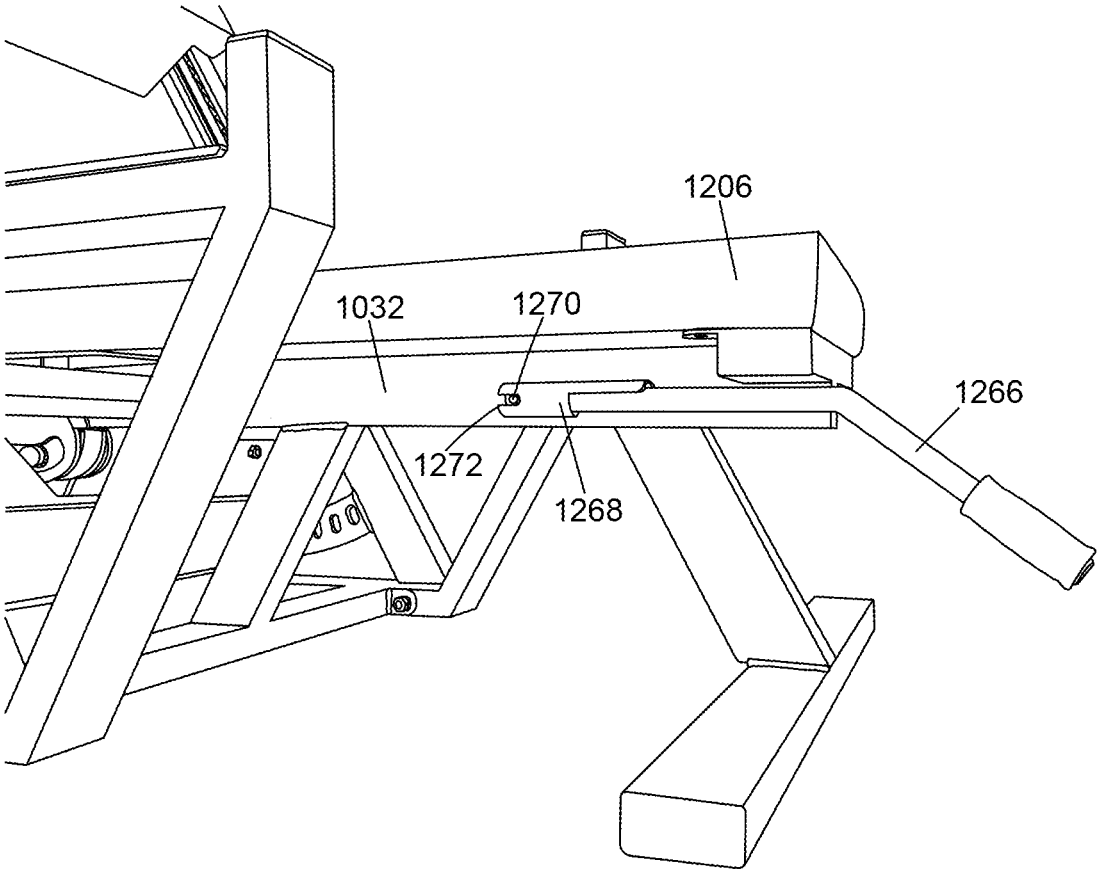
FIG. 33 is another right side perspective view of the moving handle shown in FIG. 32.

The training bench 1010 includes a moving handle 1266 that is configured to promote ease of manual movement of the training bench 1010 on the wheels 1066. In general, the moving handle 1266 is located within a handle holder housing 1268 that is secured to the side of the weight bench support member 1032 near the front end 1013 thereof. The handle 1266 is positioned underneath the weight bench 1206 when not in use and can be pulled outward past the front of the weight bench 1206 until a protruding end stop 1270 on the handle 1266 is received within and retained by a handle holder housing slot 1272. A pop pin (not shown) is secured to an opposite side of weight bench support member 1032 and is configured to maintain the handle 1266 outward once pulled to the fully outward position (FIG. 33). Having the moving handle 1266 secured outward via the pop pin promotes ease for tilting and moving the training bench 1010 on the wheels 1066 by preventing the handle 1266 from moving back inward while moving the training bench 1010. In order to return the moving handle 1266 back underneath the weight bench 1206, the pop pin must first be pulled and held outward before pushing the handle 1266 back inward.

In certain embodiments, horizontal weight plate/clip rods (not shown) may be provided to extend from the frame 1011 for the purpose of storing weight plates and/or weight clips.

The training benches 10 and 1010 can adjust to accommodate users of various sizes as well as to adjust an angle from vertical of the upper arm throughout the triceps extension motion and/or the biceps curling motion. The training benches 10 and 1010 are believed to promote the efficacy of all free weight skull crushing exercises performed by individuals in their homes as well as at gyms that may or may not have elaborate triceps weight machines. The platforms 180 and 1180 are capable of supporting barbells and the like to promote ease of a user to grab and set down a barbell by him/herself from the supine position. Furthermore, the training benches 10 and 1010 can double as biceps training devices where the user stands behind the training bench 10 or 1010 and, optionally, places one knee or foot on the training bench 10/1010 or the head rest pad 1210/1250, and executes biceps curls utilizing the upper pad 121/1121 to support their chest and the front pad 122/1122 to support their arm(s). Although not shown, knee placement pads may be located atop upper facing surfaces of the frame 11/1011 for the purpose of placing one knee against the training benches 10 and 1010 while performing standing biceps curling exercises.

Additional benefits of the training benches 10 and 1010 are provided by the construction of the UPA 73/1073, the swing arms 40/1040, and the weight bench 206/1206. For example, the UPA 73/1073 may be released and adjusted by rotating the handle 74/1074 of the rotary release assembly either clockwise or counterclockwise thereby promoting ease of use by both right-handed and left-handed users. Further, the handle 74/1074 promotes ease of release and movement of the UPA 73/1073 while standing behind the rear end of the training bench 10/1010 or while lying supine on the weight bench 206/1206. In embodiments in which the UPA 73/1073 may be moved upward along the swing arms 40/1040 without rotating the handle 74/1074, users are preferably able to push the UPA 73/1073 upward with a single hand.

As another example, the swing arm levers 46/1046 promote ease of adjusting the angle of the swing arms 40/1040 and the UPA 73/1073, and may allow a training partner, spotter, or other individual to adjust the angle of the swing arms 40/1040 and the UPA 73/1073 while a user is performing lying triceps extensions or biceps curling exercises. This may allow the other individual to adjust the intensity and/or range of motion load targeting during or within a set of repetitions. As yet another example, in embodiments in which the head pad 1210 or 1250 of the weight bench 1206 is declinable, users are potentially provided with an option to increase a range of motion of their arm(s) during lying triceps extensions, especially when the UPA 73/1073 is positioned vertically to fifteen degrees from vertical.

The training benches 10 and 1010 may include various additional features suitable for promoting its intended use. For example, it may include adjustable end range of motion target bumpers (not shown) to limit and define a range of motion of one or both of the arms of the user.

The front, rear, upper, and lower pads 122/1122, 140/1140, 121/1121, and 123/1123, as well as the padding on the weight bench 206/1206 and head pad 1210/1250 may include a cushioning material encased by vinyl, leather, or some other material. Suitable materials and construction of the pads 122, 140, 121, 123, 206, 206*b*, 1210, and 1250 may be the same or similar to materials and construction of padding used for existing weight benches.

As previously noted above, though the foregoing detailed description describes certain aspects of one or more particular embodiments of the invention, alternatives could be adopted by one skilled in the art. For example, the strength training apparatus 10/1010 and its components could differ in appearance and construction from the embodiment described herein and shown in the figures, functions of certain components of the strength training apparatus 10/1010 could be performed by components of different construction but capable of a similar (though not necessarily equivalent) function, and various materials could be used in the fabrication of the strength training apparatus 10/1010 and/or its components. As such, and again as was previously noted, it should be understood that the invention is not necessarily limited to any particular embodiment described herein or illustrated in the drawings.

The invention claimed is:

1. A strength training apparatus for use with free weights, configured to both enable a user to lie supine to perform triceps extension exercises and stand behind and lean over the strength training apparatus to perform biceps curling exercises, the strength training apparatus comprising:

a frame configured to rest on a support surface;

first and second swing arms each pivotally coupled to the frame at respective pivot points and extending from the frame above a weight bench coupled to the frame;

a user's platform armrest configured to be releasably secured to the first and second swing arms and span therebetween, the user's platform armrest having a first side configured to support upper arms of the user while the user is lying supine on the weight bench located below and underneath the user's platform armrest, the user's platform armrest also having a second side configured to support the upper arms of the user while the user is located behind and leaning over the user's platform armrest;

a swing arm angle adjuster system located below a horizontal plane of the weight bench and configured to adjust an angle of the first and second swing arms relative to the frame while the user's platform armrest is coupled to the first and second swing arms; and a platform adjusting mechanism located within the user's platform armrest and configured to adjust a position of the user's platform armrest along the first and second swing arms while the user's platform armrest is coupled to the first and second swing arms.

2. The strength training apparatus of claim 1, wherein lower ends of the first and second swing arms are respectively configured to be releasably coupled with respective ones of a pair of selector plates located below the horizontal plane of the weight bench, wherein each selector plate includes multiple holes that are equidistant from respective ones of the pivot points, and wherein each swing arm includes lock pins configured to be received within each of the multiple holes of a respective one of the pair of selector plates to releasably secure the first and second swing arms in fixed positions associated with each of the multiple holes.

3. The strength training apparatus of claim 2, wherein the lock pins are respectively coupled by cables to swing arm levers such that articulating the swing arm levers respectively pulls the cables and thereby removes the lock pins from the multiple holes of the pair of selector plates to an extent that the lock pins respectively exit the multiple holes.

4. The strength training apparatus of claim 3, wherein the swing arm levers are respectively located adjacent to distal ends of the first and second swing arms and the cables are respectively routed from the swing arm levers, through an interior cavity of each of the first and second swing arms, below the horizontal plane of the weight bench, and across the frame below the weight bench to couple with one of the lock pins, respectively.

5. The strength training apparatus of claim 3, wherein the cables are respectively coupled to the lock pins with cable assemblies and the cable assemblies are located within cavities defined by respective housings.

6. The strength training apparatus of claim 1, further comprising a counter balance system comprising one or more biasing members configured to reduce a load required to adjust the position of the user's platform armrest.

7. The strength training apparatus of claim 1, wherein the user's platform armrest includes a user's platform armrest frame and locking fingers slidably coupled with the user's platform armrest frame, the locking fingers configured to respectively slide in directions toward and away from the first and second swing arms while the user's platform armrest is respectively coupled to the first and second swing arms, wherein sides of the first and second swing arms adjacent to ends of the user's platform armrest frame respectively include locking plates having slots configured to receive lateral ends of the locking fingers, respectively, wherein the user's platform armrest is configured to be releasably locked into position along the first and second swing arms when the lateral ends of the locking fingers are respectively extended toward the first and second swing arms and located within the slots in the locking plates, and the user's platform armrest is configured to be selectively slidable along the first and second swing arms when the lateral ends of the locking fingers are respectively retracted away from the first and second swing arms and not within the slots of the locking plates.

8. The strength training apparatus of claim 7, wherein the user's platform armrest includes a rotary release assembly that includes a handle, the rotary release assembly being configured to remove the locking fingers from the slots by rotating the handle clockwise or counterclockwise relative to the user's platform armrest frame.

9. A method of performing the triceps extension exercises using the strength training apparatus of claim 1, the method comprising:

adjusting the angle of the first and second swing arms relative to the frame of the strength training apparatus while the user's platform armrest is coupled to the first and second swing arms by interacting with components of the frame located below the weight bench coupled to the frame;

lying supine on the weight bench below and underneath the user's platform armrest of the strength training apparatus;

adjusting the position of the user's platform armrest along the first and second swing arms downward toward the weight bench while the user's platform armrest is coupled to the first and second swing arms by single-handedly interacting with one or more components located within the user's platform armrest while lying supine on the weight bench below and underneath the user's platform armrest;

holding a one of the free weights with one or both hands of the user;

locating and maintaining one or both of the upper arms of the user against a side of the user's platform armrest; and performing the triceps extension exercises by repeatedly bending and extending one or both arms of the user at elbows of the user while holding the one of the free weights with the one or both hands of the one or both arms and while the one or both upper arms are against the first side of the user's platform armrest.

10. The method of claim 9, wherein the angle of the first and second swing arms is adjusted by:

disengaging lower ends of the first and second swing arms from respective ones of a pair of selector plates located below the horizontal plane of the weight bench;

pivoting the first and second swing arms relative to the frame; and engaging the lower ends of the first and second swing arms with the respective ones of the pair of selector plates.

11. The method of claim 9, wherein the angle of the first and second swing arms is adjusted by:

respectively articulating swing arm levers of the first and second swing arms to respectively remove lock pins of the first and second swing arms from first holes of selector plates located below the horizontal plane of the weight bench;

holding the swing arm levers in an articulated position while simultaneously pivoting the first and second swing arms relative to the frame; and releasing the swing arm levers to respectively insert the lock pins into second holes of the selector plates.

12. The method of claim 9, wherein the position of the user's platform armrest is adjusted by:

turning a rotary handle of the user's platform armrest clockwise or counterclockwise to respectively disengage locking fingers of the user's platform armrest from locking plates on medial sides of the first and second swing arms;

holding the rotary handle in a turned position while simultaneously moving the user's platform armrest along the first and second swing arms; and releasing the rotary handle to respectively engage the locking fingers into the locking plates on the medial sides of the first and second swing arms.

13. The method of claim 9, further comprising reducing a load required to adjust the position of the user's platform armrest by applying an upward force on the user's platform armrest with one or more biasing members of a counter balance system of the strength training apparatus.

14. The method of claim 9, further comprising adjusting an angle of a headrest relative to the weight bench.

15. A method of performing the biceps curling exercises using the strength training apparatus of claim 1, the method comprising:

adjusting the angle of the first and second swing arms relative to the frame of the strength training apparatus while the user's platform armrest is coupled to the first and second swing arms by interacting with components of the frame located below the weight bench coupled to the frame;

adjusting the position of the user's platform armrest along the first and second swing arms upward away from or downward toward the weight bench while the user's platform armrest is coupled to the first and second swing arms by single-handedly interacting with one or more components located within the user's platform armrest;

holding one of the free weights with a hand of the user while leaning over the user's platform armrest such that the user's platform armrest is between the one or both arms of the user and the weight bench; and performing the biceps curling exercises by repeatedly extending and bending the one or both arms at elbows of the user while holding the one of the free weights and while the one or both arms are against the second side of the user's platform armrest.

16. The method of claim 15, wherein the angle of the first and second swing arms is adjusted by:

disengaging lower ends of the first and second swing arms from respective ones of a pair of selector plates located below the horizontal plane of the weight bench;

pivoting the first and second swing arms relative to the frame; and engaging the lower ends of the first and second swing arms with the respective ones of the pair of selector plates.

17. The method of claim 15, wherein the angle of the first and second swing arms is adjusted by:

respectively articulating swing arm levers of the first and second swing arms to respectively remove lock pins of the first and second swing arms from first holes of selector plates located below the horizontal plane of the weight bench;

holding the swing arm levers in an articulated position while simultaneously pivoting the first and second swing arms relative to the frame; and releasing the swing arm levers to respectively insert the lock pins into second holes of the selector plates.

18. The method of claim 15, further comprising reducing a load required to adjust the position of the user's platform armrest by applying an upward force on the user's platform armrest with one or more biasing members of a counter balance system of the strength training apparatus.

19. The method of claim 15, further comprising adjusting an angle of a headrest relative to the weight bench.

* * * * *